US009333743B2

(12) United States Patent
Akune

(10) Patent No.: US 9,333,743 B2
(45) Date of Patent: May 10, 2016

(54) INKJET HEAD AND INKJET RECORDING APPARATUS

(71) Applicant: Konica Minolta, Inc., Chiyoda-ku, Tokyo (JP)

(72) Inventor: Junichirou Akune, Sagamihara (JP)

(73) Assignee: KONICA MINOLTA, INC (JP)

( * ) Notice: Subject to any disclaimer, the term of this patent is extended or adjusted under 35 U.S.C. 154(b) by 0 days.

(21) Appl. No.: 14/796,000

(22) Filed: Jul. 10, 2015

(65) Prior Publication Data

US 2016/0009080 A1 Jan. 14, 2016

(30) Foreign Application Priority Data

Jul. 11, 2014 (JP) ..... 2014-143081

(51) Int. Cl.
*B41J 29/38* (2006.01)
*B41J 2/045* (2006.01)

(52) U.S. Cl.
CPC ..... *B41J 2/04541* (2013.01); *B41J 2/0451* (2013.01); *B41J 2/04501* (2013.01); *B41J 2/04508* (2013.01); *B41J 2/04521* (2013.01); *B41J 2/04573* (2013.01); *B41J 2/04581* (2013.01)

(58) Field of Classification Search
CPC .. B41J 2/04501; B41J 2/04508; B41J 2/0451; B41J 2/04521; B41J 2/04573; B41J 2/04581
See application file for complete search history.

(56) References Cited

U.S. PATENT DOCUMENTS

2011/0273507 A1* 11/2011 Yamato ..... B41J 2/04508 347/19

FOREIGN PATENT DOCUMENTS

JP 2006240048 A 9/2006

* cited by examiner

*Primary Examiner* — Julian Huffman
(74) *Attorney, Agent, or Firm* — Cantor Colburn LLP

(57) ABSTRACT

An inkjet head includes a plurality of driving circuits, and ejecting ink in accordance with driving operation of the plurality of driving circuits based on a predetermined setting, wherein the plurality of driving circuits include a first driving circuit, and a second driving circuit electrically connected with the output of the first driving circuit, the first driving circuit includes a first storage unit, and a first setting output unit, and the second driving circuit includes a second storage unit, a second setting input unit, a second comparison unit, and a second result output unit.

25 Claims, 17 Drawing Sheets

20Y
22Y
21Y
25
out-D
out512
out385
FOURTH STAGE DRIVING CIRCUIT
234Y
out384
out257
THIRD STAGE DRIVING CIRCUIT
233Y
out256
out129
SECOND STAGE DRIVING CIRCUIT
232Y
out128
out1
FIRST STAGE DRIVING CIRCUIT
231Y
out-D
SI0..SI2, DCLK, regCLK
regEN
regRnW
regCasc(H)
regCasc(L)
VH1
VH2

FIG. 7

| No. | STB-n | STB-n | STB-n | PIXEL DATA | DRIVING WAVEFORM PATTERN DATA | | | | | | | |
|---|---|---|---|---|---|---|---|---|---|---|---|---|
| | | | | | GSC | | | | | | | |
| | | | | | 7 | 6 | 5 | 4 | 3 | 2 | 1 | 0 |
| 0 | n=1 | n=2 | n=3 | (0, 0, 0) | 1 | 1 | 1 | 1 | 0 | 1 | 1 | 0 |
| 1 | n=1 | n=2 | n=3 | (0, 0, 1) | 1 | 1 | 1 | 1 | 2 | 1 | 1 | 0 |
| 2 | n=1 | n=2 | n=3 | (0, 1, 0) | 1 | 1 | 1 | 2 | 2 | 1 | 1 | 0 |
| 3 | n=1 | n=2 | n=3 | (0, 1, 1) | 1 | 1 | 1 | 2 | 2 | 2 | 1 | 0 |
| 4 | n=1 | n=2 | n=3 | (1, 0, 0) | 1 | 1 | 2 | 2 | 2 | 2 | 1 | 0 |
| 5 | n=1 | n=2 | n=3 | (1, 0, 1) | 1 | 1 | 2 | 2 | 2 | 2 | 2 | 0 |
| 6 | n=1 | n=2 | n=3 | (1, 1, 0) | 1 | 2 | 2 | 2 | 2 | 2 | 2 | 0 |
| 7 | n=1 | n=2 | n=3 | (1, 1, 1) | 2 | 2 | 2 | 2 | 2 | 2 | 2 | 0 |
| 8 | n=2,3 | n=1,3 | n=1,2 | any | 1 | 1 | 1 | 1 | 1 | 1 | 1 | 0 |
| 9 | out-D | | | NONE | 1 | 1 | 1 | 1 | 1 | 1 | 1 | 0 |

FIG. 10

| No. | ADDRESS | DATA | | | | | | | | | | | | | | | |
|---|---|---|---|---|---|---|---|---|---|---|---|---|---|---|---|---|---|
| | | 15bit | 14bit | 13bit | 12bit | 11bit | 10bit | 09bit | 08bit | 07bit | 06bit | 05bit | 04bit | 03bit | 02bit | 01bit | 00bit |
| | | DRIVING WAVEFORM PATTERN DATA 1bit | | | | | | | | DRIVING WAVEFORM PATTERN DATA 0bit | | | | | | | |
| | | 7 | 6 | 5 | 4 | 3 | 2 | 1 | 0 | 7 | 6 | 5 | 4 | 3 | 2 | 1 | 0 |
| 0 | 00000000 | 0 | 0 | 0 | 0 | 0 | 0 | 0 | 0 | 1 | 1 | 1 | 1 | 0 | 1 | 1 | 0 |
| 1 | 00000001 | 0 | 0 | 0 | 0 | 1 | 0 | 0 | 0 | 1 | 1 | 1 | 1 | 0 | 1 | 1 | 0 |
| 2 | 00000010 | 0 | 0 | 0 | 1 | 1 | 0 | 0 | 0 | 1 | 1 | 1 | 0 | 0 | 1 | 1 | 0 |
| 3 | 00000011 | 0 | 0 | 0 | 1 | 1 | 1 | 0 | 0 | 1 | 1 | 1 | 0 | 0 | 0 | 1 | 0 |
| 4 | 00000100 | 0 | 0 | 1 | 1 | 1 | 1 | 0 | 0 | 1 | 1 | 0 | 0 | 0 | 0 | 1 | 0 |
| 5 | 00000101 | 0 | 0 | 1 | 1 | 1 | 1 | 1 | 0 | 1 | 1 | 0 | 0 | 0 | 0 | 0 | 0 |
| 6 | 00000110 | 0 | 1 | 1 | 1 | 1 | 1 | 1 | 0 | 1 | 0 | 0 | 0 | 0 | 0 | 0 | 0 |
| 7 | 00000111 | 1 | 1 | 1 | 1 | 1 | 1 | 1 | 0 | 0 | 0 | 0 | 0 | 0 | 0 | 0 | 0 |
| 8 | 00001000 | 0 | 0 | 0 | 0 | 0 | 0 | 0 | 0 | 1 | 1 | 1 | 1 | 1 | 1 | 1 | 0 |
| 9 | 00001001 | 0 | 0 | 0 | 0 | 0 | 0 | 0 | 0 | 1 | 1 | 1 | 1 | 1 | 1 | 1 | 0 |

INKJET HEAD AND INKJET RECORDING APPARATUS

CROSS REFERENCE TO RELATED APPLICATIONS

The present invention claims priority under 35 U.S.C. §119 to Japanese Application No. 2014-143081 filed on Jul. 11, 2014, the entire content of which is incorporated herein by reference.

BACKGROUND OF THE INVENTION

1. Field of the Invention

The present invention relates to an inkjet head and an inkjet recording apparatus 2. Description of the Related Art An inkjet recording apparatus known in the art forms an image on a recording medium by ejecting ink at controlled timing from a plurality of nozzles formed in an inkjet head. Examples of ink ejection methods often used include a piezoelectric method which ejects ink from a nozzle communicating with an ink storing pressure chamber in accordance with variations of the pressure inside the pressure chamber varied with changes of voltage applied to a piezoelectric element provided on a wall surface of the pressure chamber via a driving circuit, and a thermal method which pushes out ink with bubbles generated in an ink channel when ink is heated by a heater provided at a nozzle end and powered by a driving circuit, for example.

Also known is an inkjet head configured to include a plurality of cascade-connected driving circuits. Further known is a technology which provides a storage unit such as a register in each of driving circuits, and ejects ink based on various settings stored in each of the storage units. For example, JP 2006-240048 A discloses a technology which stores nozzle driving voltage waveform pattern data in registers of driving circuits as data corresponding to pixel data, selects appropriate driving voltage waveform pattern data in accordance with pixel data for an image at the time of formation of the image, and ejects ink by applying driving voltage in correspondence with the selected driving voltage waveform pattern data.

For allowing operation of a plurality of driving circuits based on identical settings, identical setting data needs to be written to each of the storage units of the plurality of driving circuits. However, there occurs in some cases such a problem that not identical data has been written to each of the storage units. When the storage units contain different data, the plurality of driving circuits operate based on different settings.

SUMMARY OF THE INVENTION

It is an object of the present invention to provide an inkjet head and an inkjet recording apparatus, capable of easily recognizing that identical data has been written to each of storage units of a plurality of driving circuits.

To achieve the abovementioned object, according to an aspect, an inkjet head reflecting one aspect of the present invention comprises a plurality of driving circuits, and ejecting ink in accordance with driving operation of the plurality of driving circuits based on a predetermined setting, wherein the plurality of driving circuits include a first driving circuit, and a second driving circuit electrically connected with the output of the first driving circuit, the first driving circuit includes a first storage unit that stores the predetermined setting, and a first setting output unit that reads at least a part of the predetermined setting and outputs the read part as reading data, and the second driving circuit includes a second storage unit that stores the predetermined setting, a second setting input unit to which output of the first setting output unit is input, a second comparison unit that compares reading data input from the second setting input unit, and data included in the predetermined setting stored in the second storage unit and corresponding to a part associated with the reading data, and a second result output unit that outputs a comparison result of the second comparison unit.

In the inkjet head of Item. 1 according to Item. 2 of the present invention, the plurality of driving circuits preferably include a third driving circuit electrically connected with the output of the second driving circuit, the second driving circuit preferably includes a second setting output unit that outputs, as reading data, at least a part of the predetermined setting stored in the second storage unit, and the third driving circuit preferably includes a third storage unit that stores the predetermined setting, a third setting input unit to which output of the second setting output unit is input, a third result input unit to which a comparison result output from the second result output unit is input, a third comparison unit that compares reading data input from the third setting input unit, and data included in the predetermined setting stored in the third storage unit and corresponding to a part associated with the reading data, and a third accumulated comparison result output unit that outputs an accumulated comparison result obtained by accumulating a comparison result of the third comparison unit and a comparison result input from the third result input unit.

To achieve the abovementioned object, according to an aspect, an inkjet head reflecting one aspect of the present invention comprises a plurality of driving circuits, and ejecting ink in accordance with driving operation of the plurality of driving circuits based on a predetermined setting, wherein the plurality of driving circuits include a first driving circuit, and a second driving circuit electrically connected with the output of the first driving circuit, the first driving circuit includes a first storage unit that stores the predetermined setting, a first setting output unit that reads at least a part of the predetermined setting and outputs the read part as reading data, a first comparison unit that compares at least the part of the read part of the predetermined setting stored in the first storage unit and predetermined reference data, and a first result output unit that outputs a comparison result of the first comparison unit, and the second driving circuit includes a second storage unit that stores the predetermined setting, a second setting input unit to which output of the first setting output unit is input, a second comparison unit that compares reading data input from the second setting input unit, and data included in the predetermined setting stored in the second storage unit and corresponding to a part associated with the reading data, a second result input unit to which output from the first result output unit is input, and a second accumulated comparison result output unit that outputs an accumulated comparison result obtained by accumulating a comparison result of the second comparison unit and input from the second result input unit.

In the inkjet head of Item. 3 according to Item. 4 of the present invention, the plurality of driving circuits preferably include a third driving circuit electrically connected with the output of the second driving circuit, the second driving circuit preferably includes a second setting output unit that outputs, as reading data, at least a part of the predetermined setting stored in the second storage unit, and the third driving circuit preferably includes a third storage unit that stores the predetermined setting, a third setting input unit to which output of the second setting output unit is input, a third accumulated comparison result input unit to which an accumulated comparison result output from the second accumulated comparison result output unit is input, a third comparison unit that compares reading data input from the third setting input unit, and data included in the predetermined setting stored in the third storage unit and corresponding to a part associated with the reading data, and a third accumulated comparison result output unit that outputs an accumulated comparison result obtained by accumulating a comparison result of the third comparison unit and an accumulated comparison result input from the third accumulated comparison result input unit.

In the inkjet head of Item. 1 or 3 according to Item. 5 of the present invention, the first driving circuit preferably includes a first setting information input unit to which setting information associated with the predetermined setting is input, and a first setting information output unit that outputs the setting information, the second driving circuit preferably includes a second setting information input unit to which the setting information output from the first setting information output unit is input, and a range of reading data output from the first setting output unit, and a range of data included in the predetermined setting stored in the second storage unit, corresponding to a part associated with the reading data, and compared by the second comparison unit are defined based on the setting information.

In the inkjet head of Item. 5 according to Item. 6 of the present invention, the inkjet head further preferably comprises a reading/writing switch unit that allows switching between a writing mode for writing the predetermined setting to the first storage unit and the second storage unit, and a reading mode for outputting reading data from the first storage unit and the second storage unit, and the setting information preferably contains the predetermined setting to be written in the writing mode.

In the inkjet head of Item. 6 according to Item. 7 of the present invention, the inkjet head preferably further comprises an input switch unit that switches output of input data input to the first setting information input unit, between output of the input data to the first storage unit and the second storage unit as the setting information associated with output of the predetermined setting writing or reading data, and output of the input data to a predetermined storage unit as input data for defining driving operation associated with an amount of the ink ejection.

In the inkjet head of any one of Items. 1, 3, 5, 6, and 7 according to Item. 8 of the present invention, the second comparison unit preferably compares data for comparison by a predetermined unit of data.

In the inkjet head of Item. 2 or 4 according to Item. 9 of the present invention, the first driving circuit preferably includes a first setting information input unit to which setting information associated with the predetermined setting is input, and a first setting information output unit that outputs the setting information, the second driving circuit preferably includes a second setting information input unit to which the setting information output from the first setting information output unit is input, and a second setting information output unit that outputs the setting information, the third driving circuit preferably includes a third setting information input unit to which the setting information output from the second setting information output unit is input, and a range of reading data output from each of the first setting output unit and the second setting output unit, and a range of data included in the predetermined setting stored in the third storage unit, corresponding to a part associated with the reading data, and compared by the third comparison unit are defined based on the setting information.

In the inkjet head of Item. 9 according to Item. 10 of the present invention, the inkjet head preferably further comprises a reading/writing switch unit that allows switching between a writing mode for writing the predetermined setting to the first storage unit, the second storage unit, and the third storage unit, and a reading mode for outputting reading data from the first storage unit, the second storage unit, and the third storage unit, and the setting information preferably contains the predetermined setting to be written in the writing mode.

In the inkjet head of Item. 10 according to Item. 11 of the present invention, the inkjet head preferably further comprises an input switch unit that switches output of input data input to the first setting information input unit, between output of the input data to the first storage unit, the second storage unit, and the third storage unit as the setting information associated with output of the predetermined setting writing or reading data, and output of the input data to a predetermined storage unit as input data for defining driving operation associated with an amount of the ink ejection.

In the inkjet head of any one of Items. 2, 4, 9, 10, and 11 according to Item. 12 of the present invention, the second comparison unit and the third comparison unit preferably compare data for comparison by a predetermined unit of data.

In the inkjet head of Item. 12 according to Item. 13 of the present invention, the third accumulated comparison result output unit preferably accumulates and outputs comparison results each containing different contents of the data compared by the predetermined unit of data.

In the inkjet head of Item. 3 or 4 according to Item. 14 of the present invention, the second comparison unit preferably compares the data for comparison by a predetermined unit of data, and the second accumulated comparison result output unit preferably accumulates and outputs comparison results each containing different contents of the data compared by the predetermined unit of data.

In the inkjet head of any one of Items. 8, 12, 13, and 14 according to Item. 15 of the present invention, the predetermined unit of data is preferably one bit.

In the inkjet head of Item. 15 according to Item. 16 of the present invention, the second comparison unit preferably includes an exclusive OR circuit to which reading data input from the second setting input unit, and data included in the predetermined setting stored in the second storage unit and corresponding to a part associated with the reading data are input.

In the inkjet head of Item. 12 or 13 according to Item. 17 of the present invention, the predetermined unit of data is preferably one bit, the second comparison unit preferably includes an exclusive OR circuit to which reading data input from the second setting input unit, and data included in the predetermined setting stored in the second storage unit and corresponding to a part associated with the reading data are input, and the third comparison unit preferably includes an exclusive OR circuit to which reading data input from the third setting input unit, and data included in the predetermined setting stored in the third storage unit and corresponding to a part associated with the reading data are input.

In the inkjet head of Item. 3 or 4 according to Item. 18 of the present invention, the first comparison unit preferably includes an exclusive OR circuit to which the predetermined reference data, and the reading data from the first storage unit are input, and an AND circuit that has inputs one of which receives output from the exclusive OR circuit, a signal that defines output from the AND circuit as false is preferably input to the other input of the AND circuit, and the first comparison unit preferably obtains output from the AND circuit as a comparison result.

In the inkjet head of Item. 3 or 4 according to Item. 19 of the present invention, the first comparison unit preferably includes an exclusive OR circuit that has inputs one of which receives the reading data from the first storage unit, and data included in the correct predetermined setting and corresponding to a part associated with the reading data from the first storage unit is preferably input to the other input of the exclusive OR circuit as the predetermined reference data, and the first comparison unit preferably obtains output from the exclusive OR circuit as a comparison result.

In the inkjet head of any one of Items. 1 to 19 according to Item. 20 of the present invention, the predetermined setting is preferably driving waveform pattern data that defines driving operation associated with the amount of ink ejection.

An inkjet recording apparatus according to Item. 21 of the present invention preferably comprises the inkjet head according to any one of Items. 1 to 20.

BRIEF DESCRIPTION OF THE DRAWINGS

The above and other objects, advantages and features of the present invention will become more fully understood from the detailed description given hereinbelow and the appended drawings which are given byway of illustration only, and thus are not intended as a definition of the limits of the present invention, and wherein:

FIG. 7 is a view illustrating a conversion table from pixel data to driving waveform pattern data;

FIG. 10 is a view illustrating data stored in a register and addresses of the data;

DESCRIPTION OF THE PREFERRED EMBODIMENTS

Hereinafter, an embodiment of the present invention will be described with reference to the drawings. However, the scope of the invention is not limited to the illustrated examples.

<Configuration of Inkjet Recording Apparatus>

Figure 1:
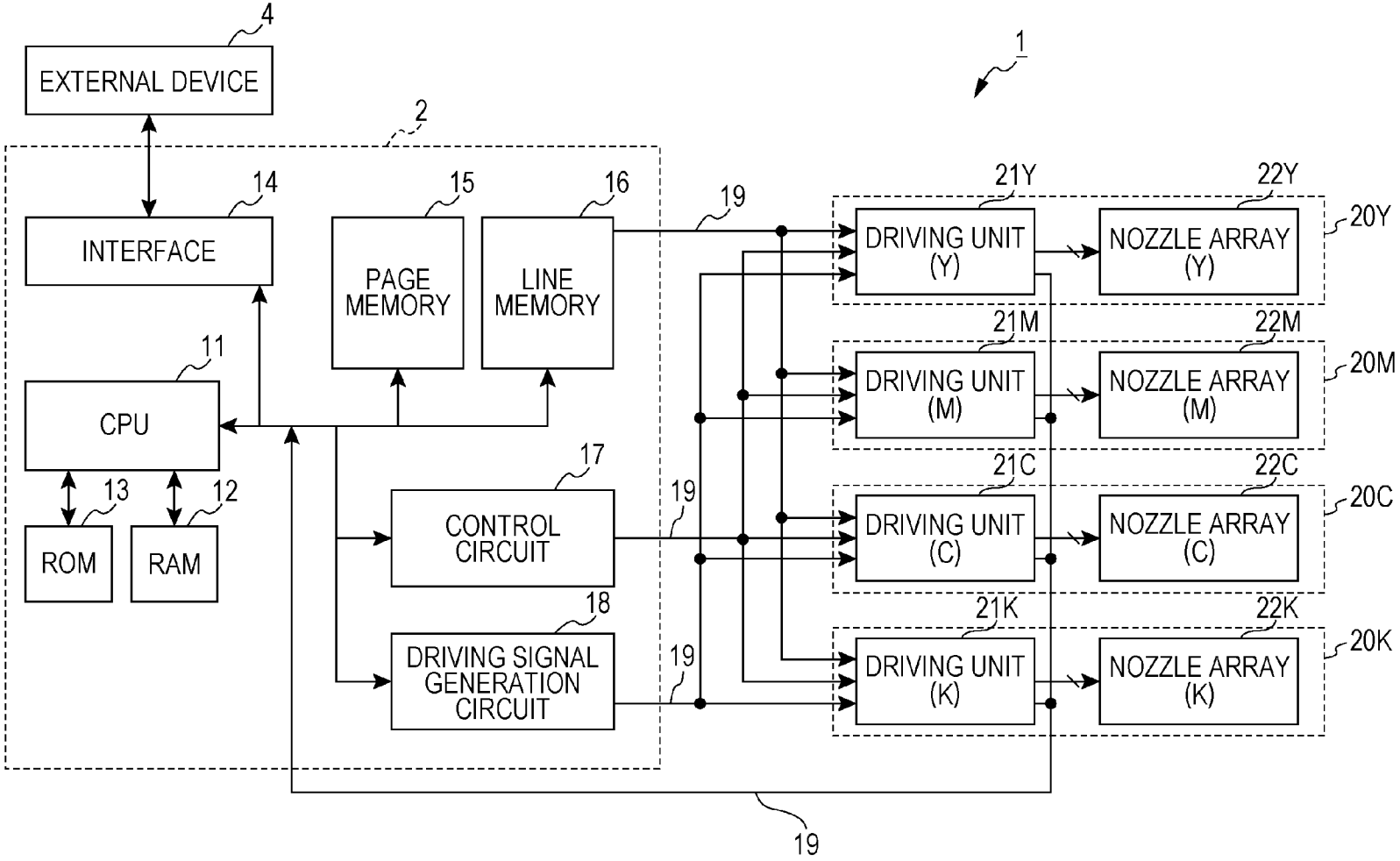
FIG. 1 is a block diagram illustrating an electric configuration of an inkjet recording apparatus.

FIG. 1 is a block diagram illustrating an electric configuration of an inkjet recording apparatus 1.

The inkjet recording apparatus 1 includes a body 2, and inkjet heads 20Y, 20M, 20C, and 20K (hereinafter abbreviated as inkjet heads 20 as well where color distinction is unnecessary) corresponding to colors of yellow, magenta, cyan, and black, respectively, and connected with the body 2 via flexible cables containing wires 19. The inkjet heads 20Y, 20M, 20C, and 20K include nozzle arrays 22Y, 22M, 22C, and 22K (hereinafter abbreviated as nozzle arrays 22 as well where color distinction is unnecessary), respectively. Each of the nozzle arrays 22 is constituted by a plurality of nozzles and ejects ink in the corresponding color of yellow, magenta, cyan, and black. Each of the nozzles included in each of the nozzle arrays 22 communicates with a channel (pressure chamber) which stores ink, and ejects ink from the nozzle in accordance with variations of the pressure inside the pressure chamber produced when voltage is applied to a piezoelectric element provided on a wall surface of the channel.

The inkjet heads 20Y, 20M, 20C, and 20K include driving units 21Y, 21M, 21C, and 21K (hereinafter abbreviated as driving units 21 as well where color distinction is unnecessary), respectively. The driving units 21Y, 21M, 21C, and 21K are electrically connected with the corresponding piezoelectric elements provided in correspondence with the nozzles of each of the nozzle arrays 22Y, 22M, 22C, and 22K. The driving units 21 supply driving voltage to the respective piezoelectric elements to allow ejection of ink at predetermined timing from the respective nozzles included in each of the nozzle arrays 22.

The inkjet heads 20 form an image on a recording medium by ejecting ink from the nozzles of each of the nozzle arrays 22 in accordance with driving voltage supplied from the driving units 21.

The body 2 includes a CPU (Central Processing Unit) 11, and further includes a RAM (Random Access Memory) 12, a ROM (Read Only Memory) 13, an interface 14, a page memory 15, a line memory 16, a control circuit 17, and a driving signal generation circuit 18, all of which units 12 to 18 are electrically connected with the CPU 11. The CPU 11 loads programs stored in the ROM 13 to the RAM 12, and controls operations of the respective units of the inkjet recording apparatus 1 under these programs.

The interface 14 is a unit for transmitting and receiving data to and from an external device 4 such as a personal computer. The interface 14 is constituted by any of various types of serial interfaces, various types of parallel interfaces, or combinations of these interfaces.

The page memory 15 stores image data received from the external device 4. The image data in this context is data representing an entire target image to be formed on a recording medium, as data constituted by a group of pixel data. The inkjet recording apparatus 1 forms an image on the recording medium in accordance with the image data by supplying driving voltage corresponding to the image data from the driving units 21 to the piezoelectric elements provided in correspondence with the nozzles of each of the nozzle arrays 22.

The line memory 16 is a memory which stores pixel data for the respective nozzles of each of the nozzle arrays 22 at the time of image formation on the recording medium. The pixel data in this context is data representing a gradation of one pixel corresponding to a unit of recording by the inkjet recording apparatus 1. The pixel data is supplied from the page memory 15 to the line memory 16. The pixel data stored in the line memory 16 is supplied to the driving units 21 via the flexible cables.

In addition, the line memory 16 temporarily stores data and addresses of the data, and supplies the stored data and addresses to the driving units 21 at the time of writing of the data into registers 46 (see FIG. 5) included in the driving units 21, or reading of the data from the registers 46. According to an example, the data and addresses are supplied from the ROM 13 to the line memory 16. Alternatively, the data and addresses may be written from the external device 4 into the line memory 16 via the interface 14.

The control circuit 17 supplies various types of control signals to the driving units 21. The control signals include signals for controlling timing and operation of transfer of pixel data, supply of driving voltage or the like. The control signals further include signals for controlling timing and operation of writing and reading of data to and from the registers 46 included in the driving units 21.

The driving signal generation circuit 18 supplies driving signals to the driving units 21 as signals specifying waveforms of driving voltage to be generated by the driving units 21. The driving signal generation circuit 18 stores three types of driving signals (driving signal pulse_timing0 containing non-ejection waveform, driving signal pulse_timing1 containing non-operation waveform, and driving signal pulse_timing2 containing ejection waveform) stored as digital data in a not-shown line memory. This line memory is constituted by SRAM, for example.

Figure 2:
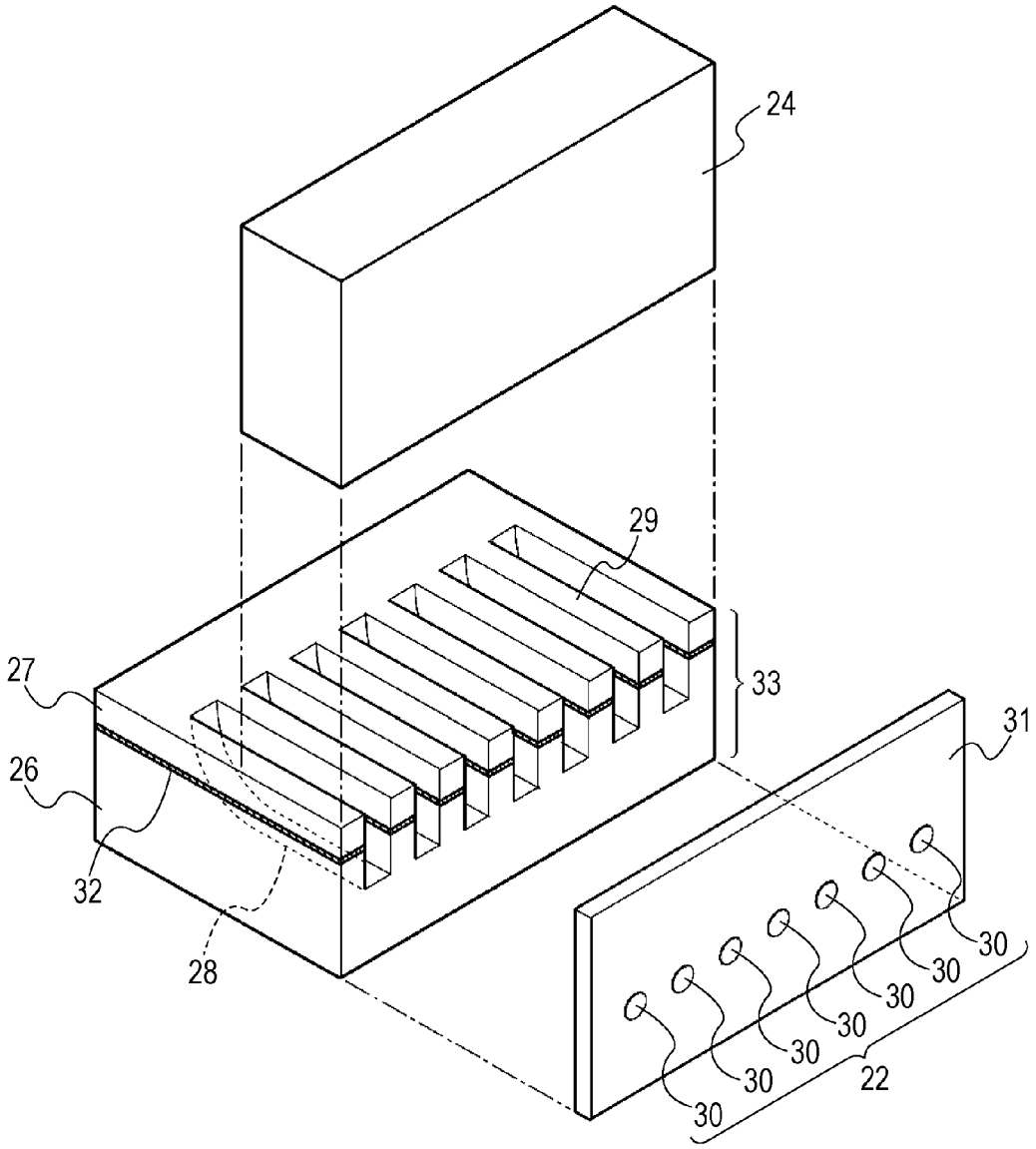
FIG. 2 is an exploded perspective view illustrating a configuration of a head body of an inkjet head in a shear mode.

FIG. 2 is an exploded perspective view illustrating a configuration of a head body of one of the inkjet heads 20 in a shear mode. While FIG. 2 schematically illustrates the head body including seven nozzles 30, the nozzle array 22 of each of the inkjet heads 20 of the present embodiment actually includes 512 nozzles 30.

The inkjet head 20 includes a channel substrate 33 containing channels 28 (ink channels). A nozzle plate 31 containing the nozzles 30 as ink ejection ports is bonded to an end surface of the channel substrate 33. The nozzles 30 communicate with the channels 28 of the channel substrate 33 to allow ejection of ink stored in the channels 28. A cover plate 24 is attached to an upper part of the channel substrate 33 on the nozzle plate 31 side.

The channel substrate 33 is constituted by two substrates 26 and 27 bonded to each other via bonding portions 32. The substrates 26 and 27 are made of piezoelectric material such as lead zirconate titanate (PZT), and polarized in opposite directions in the thickness direction. The channel substrate 33 contains the plurality of channels 28 disposed at equal intervals, and partition walls 29 formed between the respective channels 28. In other words, the channel substrate 33 includes the channels 28 and the partition walls 29 so disposed as to be alternately positioned. The nozzle plate 31 contains the plurality of nozzles 30 disposed in a line at positions corresponding to the channels 28 to constitute the nozzle array 22. The plurality of nozzles 30 are divided into a plurality of groups A to C arranged in the order of A group, B group, C group, and A group (continuing) for each position of the nozzles 30, so that ink can be ejected from each of these groups.

Figure 3A:
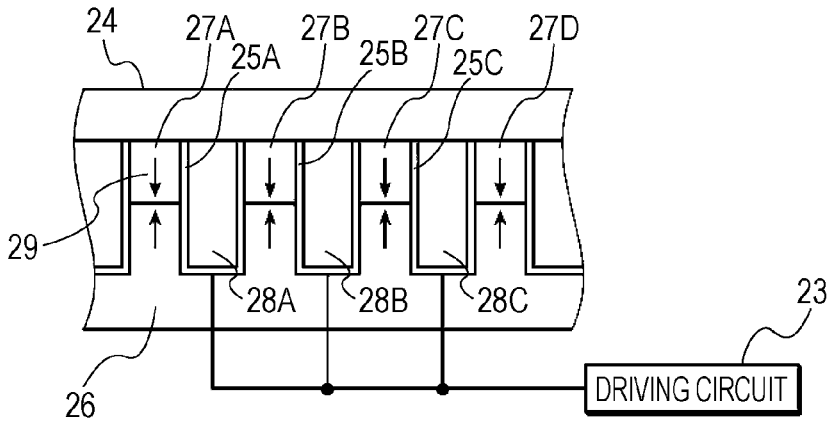
FIGS. 3A to 3C are cross-sectional views illustrating basic operation of the inkjet head in the shear mode.
Figure 3B:
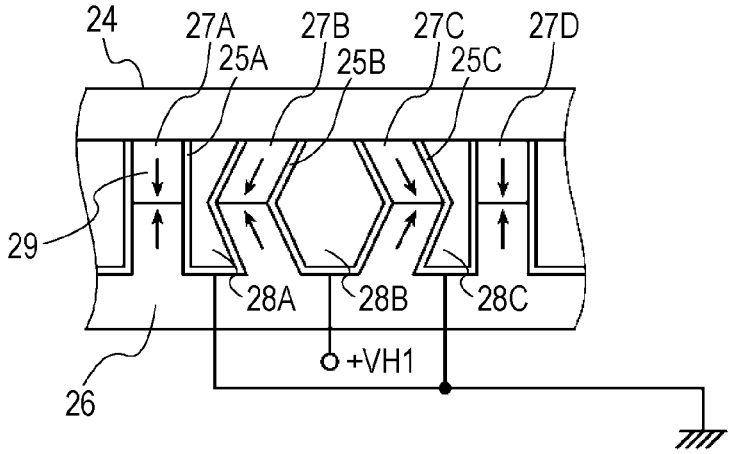
Figure 3C:
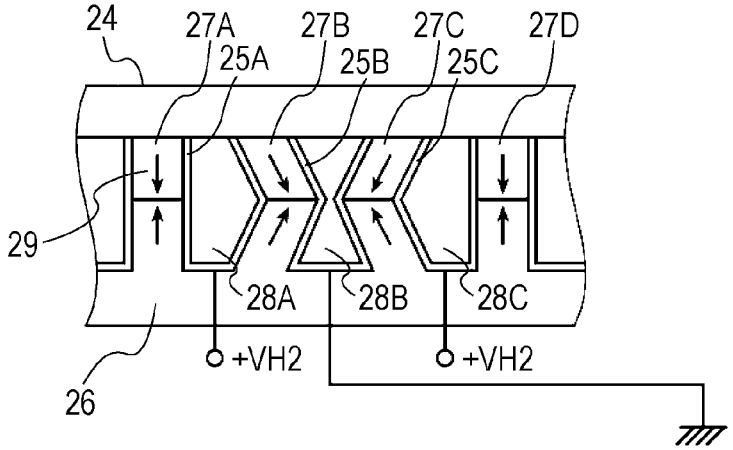

FIGS. 3A to 3C are cross-sectional views illustrating basic operation of the inkjet head 20 in the shear mode. FIG. 3A illustrates the partition walls 29 not in a state of shear deformation, while FIGS. 3B and 3C illustrate the partition walls 29 in the state of the shear deformation. FIGS. 3A to 3C are cross-sectional views of the inkjet head 20 taken along a plane parallel with the nozzle plate 31.

According to the inkjet head 20 in the shear mode, U-shaped metal electrodes 25 (25A, 25B, and 25C) made of metal such as aluminum are formed in the shape of film on the side walls of the respective channels 28 (28A, 28B, and 28C). As noted above, the substrates 26 and 27 are polarized in the opposite directions. Accordingly, when driving voltage is applied to the respective electrodes 25, the corresponding partition walls 29 produce bends (shear-deformation) centered at the bonding portions 32 between the substrates 26 and 27 in accordance with the applied voltage as illustrated in FIGS. 3B and 3C. Pressure applied to the ink is variable in accordance with variations of the volumes of the respective channels 28. When the pressure applied to the ink reaches a predetermined value, ink comes out from the nozzles 30.

More specifically, as illustrated in FIG. 3B, the partition walls 29 produce shear-deformation and increase the volume of the channel 28B in response to supply of a voltage VH1 to the electrode 25B and supply of a reference voltage (GND) to the electrodes 25A and 25C. Thereafter, as illustrated in FIG. 3C, the partition walls 29 produce shear-deformation and decrease the volume of the channel 28B in response to supply of the reference voltage to the electrode 25B and supply of a voltage VH2 (<VH1) to the electrodes 25A and 25C. As a result, high pressure is applied to ink within the channel 28B, whereby ink is ejected from the nozzle 30.

According to the present specification, mechanisms for allowing ejection of ink from the nozzles 30 are collectively referred to as an "ink ejection mechanism" as well. This ink ejection mechanism includes the electrode 25, the channel 28, the partition wall 29, and the nozzle 30. An element constituted by the electrode 25 and the partition wall 29 of the ink ejection mechanism and producing shear-deformation in response to driving voltage applied to the electrode 25 is also referred to as a piezoelectric element.

Discussed hereinafter is a configuration of the driving units 21 each of which supplies driving voltage to the piezoelectric elements of the ink ejection mechanisms corresponding to the respective nozzles of the corresponding nozzle array 22.

Figure 4:
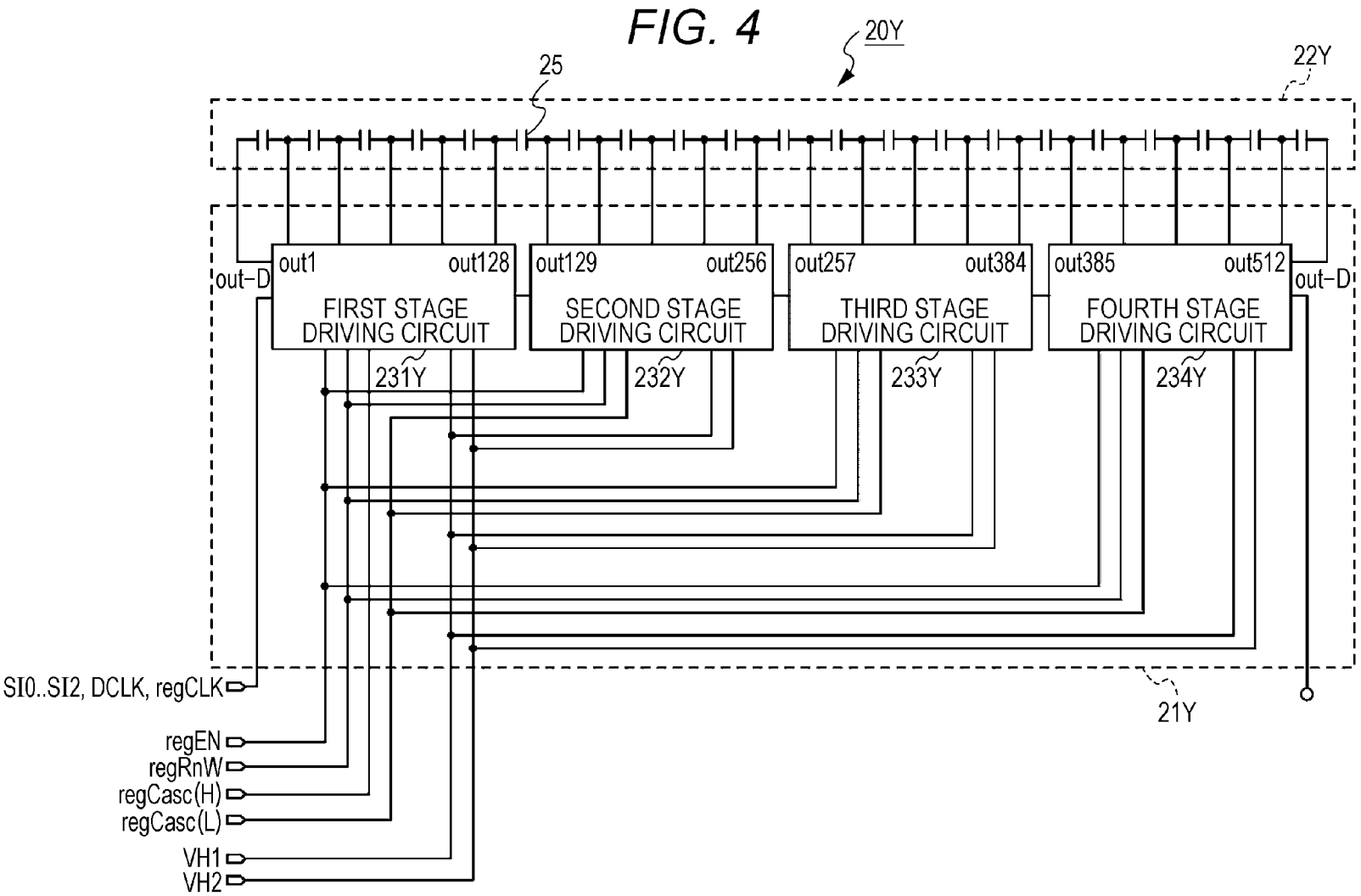
FIG. 4 is a view illustrating a general configuration of a driving unit included in the inkjet head.

FIG. 4 is a view illustrating a general configuration of the driving unit 21Y included in the inkjet head 20Y. The respective driving units 21Y, 21M, 21C, and 21K have similar configurations, wherefore only the configuration of the driving unit 21Y is herein described. The number of terminals of each of driving circuits 23 shown in FIG. 4 is smaller than the actual number of these terminals.

The driving unit 21Y is configured to include electrically cascade-connected (serial-connected) first stage driving circuit 231Y (first driving circuit), second stage driving circuit 232Y (second driving circuit), third stage driving circuit 233Y (third driving circuit), and fourth stage driving circuit 234Y, which stage driving circuits 231Y to 234Y are collectively referred to as the driving circuits 23 as well where distinction between the circuits is unnecessary. More specifically, the second stage driving circuit 232Y is electrically connected with the output of the first state driving circuit 231Y, the third stage driving circuit 233Y is electrically connected with the output of the second stage driving circuit 232Y, and the fourth stage driving circuit 234Y is electrically connected with the output of the third stage driving circuit 233Y. Each of the driving circuits 23 may be constituted by a semiconductor integrated circuit having an identical configuration. According to the configuration of the four driving circuits 23 connected in series, respective bit values SI0, SI1, and SI2 of pixels data as serial input data to the first stage driving circuit 231Y from the line memory 16 are sequentially transferred to the second stage driving circuit 232Y, the third stage driving circuit 233Y, and the fourth stage driving circuit 234Y.

The first stage driving circuit 231Y receives a clock signal DCLK generated for transfer of pixel data, and a clock signal regCLK generated for data writing and reading to and from the register 46. Each of the four driving circuits 23 receives various types of control signals such as an enable signal regEN allowing writing to the register 46, a writing/reading selection signal regRnW, and a setting signal regCasc indicating a head of cascade connection. In addition, each of the four driving circuits 23 receives supply of the voltage VH1 and the voltage VH2 from a power supply circuit. In this case, the setting signal regCasc input to the first stage driving circuit 231Y disposed at the head is fixed to a high level signal, while the setting signal regCasc input to each of the second stage driving circuit 232Y, the third stage driving circuit 233Y, and the fourth stage driving circuit 234Y is fixed to a low level signal (high level signal and low level signal are hereinafter abbreviated as "H", and "L" as well). The clock signal regCLK, the enable signal regEN, the writing/reading selection signal regRnW, and the setting signal regCasc are signals generated for allowing writing and reading data to and from the register 46. The details of these signals will be described later.

The first stage driving circuit 231Y generates driving voltage to be supplied to the piezoelectric elements of the 128 ink ejection mechanisms of the nozzle array 22Y, and outputs the generated driving voltage from terminals out1 to out128 to the electrodes 25 of the respective piezoelectric elements. Similarly, each of the second stage driving circuit 232Y, the third stage driving circuit 233Y, and the fourth stage driving circuit 234Y generates driving voltage corresponding to the 128 ink ejection mechanisms, and outputs the generated driving voltage from terminals out129 to out256, terminals out257 to out384, and terminals out385 to out512, respectively.

Each of the first stage driving circuit 231Y and the fourth stage driving circuit 234Y includes a terminal out-D for outputting driving voltage for a dummy channel. The dummy channel is provided outside the ink ejecting endmost channel 28 of the nozzle array 22 as a channel not ejecting ink. The dummy channel prevents a drop of an ejection amount of ink from the ink ejecting endmost channel 28.

As described herein, the driving unit 21Y supplies driving voltage to the nozzle array 22Y containing the 512 nozzles 30 to allow ink ejection therefrom. Similarly, each of the nozzle arrays 22M, 22C, and 22K contains the 512 nozzles 30, and ejects ink from the respective nozzles 30 in response to driving voltage supplied from the driving units 21M, 21C, and 21K.

Figure 5:
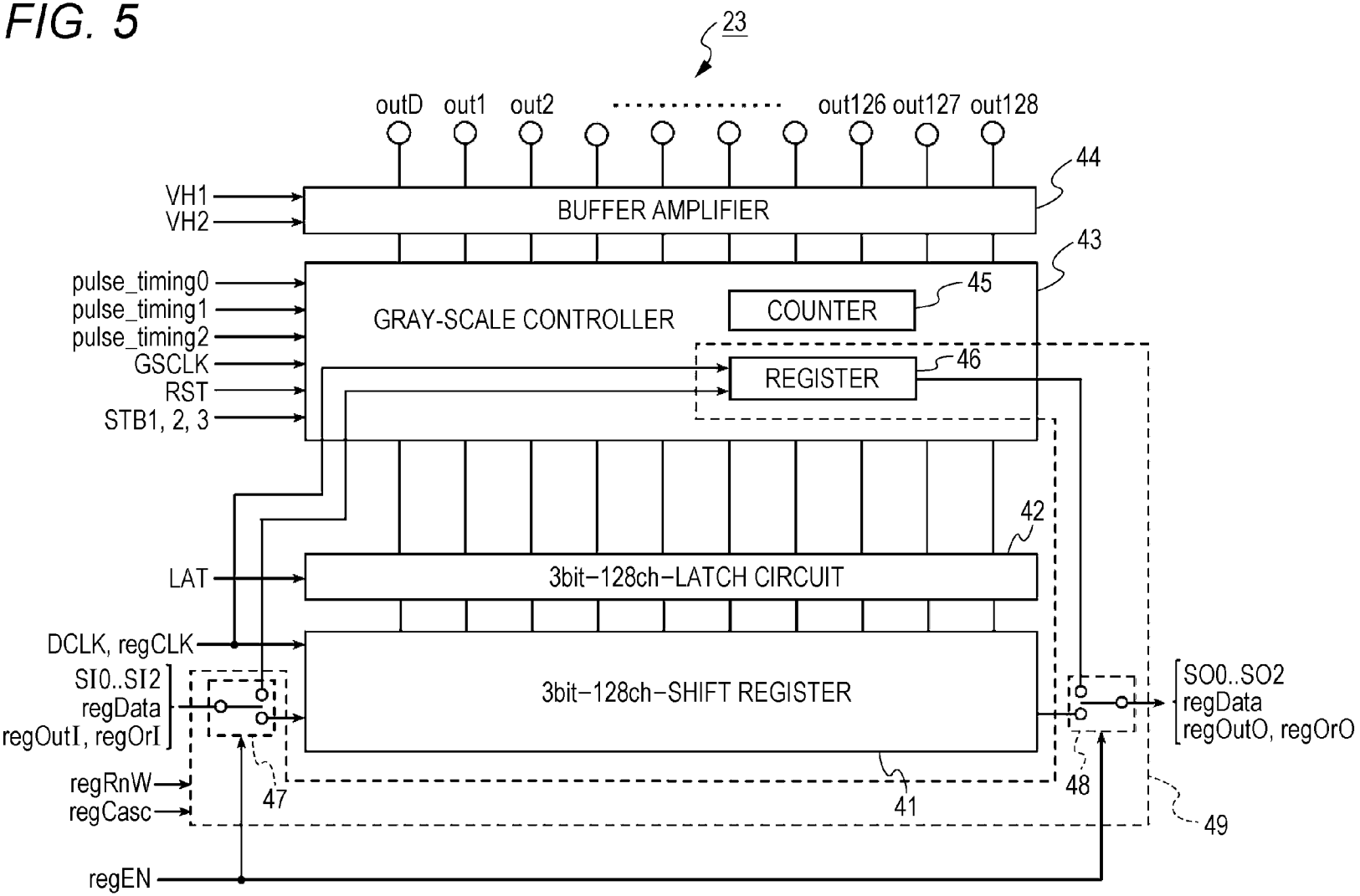
FIG. 5 is a view illustrating an internal configuration of a driving circuit.

FIG. 5 is a view illustrating an internal configuration of one of the driving circuits 23. The respective driving circuits 23 included in each of the driving units 21 have an identical configuration.

The driving circuit 23 includes a shift register 41, a latch circuit 42, a gray-scale controller (waveform selection unit) 43, a buffer amplifier 44, an input switch unit 47, and an output switch unit 48. The gray-scale controller 43 includes a counter 45 and the register 46. The registers 46 included in the first stage driving circuits 231Y to the fourth stage driving circuit 234Y correspond to a first stage storage unit (first storage unit), a second stage storage unit (second storage unit), a third storage unit (third storage unit), and a fourth stage storage unit (fourth storage unit), respectively.

The number of wires connecting the shift register 41, the latch circuit 42, the gray-scale controller 43, and the buffer amplifier 44, and the number of output terminals of the buffer amplifier 44 illustrated in FIG. 5 are smaller than the actual numbers of the corresponding wires and terminals.

The shift register 41 is an FIFO type memory which stores 3-bit data for each of 128 channels. The shift register 41 transfers 3-bit pixel data per one pixel input from the line memory 16 via the input switch unit 47 in synchronization with the transfer clock signal DCLK, and stores the data. The bit values SI0 to SI2 of pixel data are stored as 128 data for each in the order of input to the shift register 41, and then output via the output switch unit 48 as bit values SO0 to SO2. The 3×128 bit data stored in the shift register 41 is collectively output to the latch circuit 42 as parallel data at predetermined timing. According to the inkjet recording apparatus 1, 512 pixel data are input for each bit into the shift register 41 of the first stage driving circuit 231Y, while 384 pixel data for each bit previously input are output from the shift register 41 of the first stage driving circuit 231Y as bit values SO0, SO1, and SO2, and then input to the cascade-connected second stage driving circuit 232Y as bit values SI0, SI1, and SI2. Similarly, the head 256 pixel data contained in the 384 pixel data for each bit input to the second stage driving circuit 232Y are transferred to the third stage driving circuit 233Y, while the head 128 pixel data contained in the 256 pixel data for each bit input to the third stage driving circuit 233Y are transferred to the fourth stage driving circuit 234Y. Accordingly, 128 pixel data from each of the shift registers 41 of the first stage driving circuit 231Y, the second stage driving circuit 232Y, the third stage driving circuit 233Y, and the fourth stage driving circuit 234Y, i.e., 512 pixel data in total, are output from the respective stage driving circuits 231Y to 234Y and input to the latch circuit 42 in parallel.

The latch circuit 42 holds the 3-bit data for 128 channels output from the shift registers 41 until a time designated by a latch signal LAT, and outputs the 3-bit data to the gray-scale controller 43 at the designated time.

The gray-scale controller 43 outputs a selection signal indicating a driving voltage pattern (see FIG. 8) to the buffer amplifier 44 in accordance with a gradation represented by 3-bit pixel data input from the latch circuit 42.

The gray-scale controller 43 receives a synchronous clock signal GSCLK, a reset signal RST, nozzle group selection signals STB-1, STB-2, and STB-3 from the control circuit 17. The nozzle group selection signals STB-1, STB-2, and STB-3 are signals for dividing the ink ejection mechanisms containing 512 nozzles 30 into three groups of the group A, group B, and group C, and allowing sequential ink ejection from each of the groups.

The counter 45 provided on the gray-scale controller 43 counts a gray-scale count GSC (0 to 7), and outputs the result as a count value. The gray-scale count GSC indicates which waveform in the driving voltage pattern is to be output in the current period.

Figure 6:
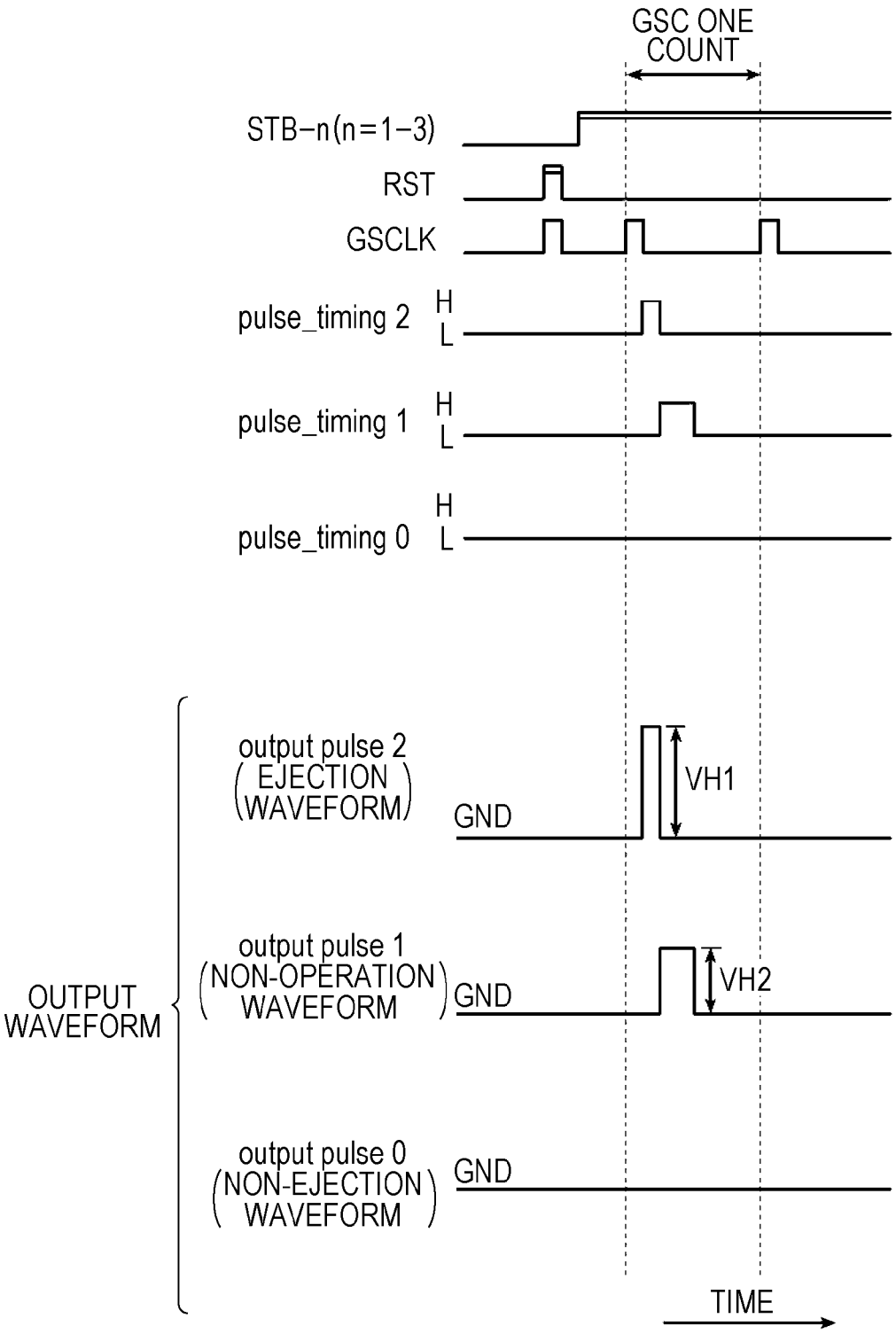
FIG. 6 is a view illustrating output waveforms of driving signals, including an ejection waveform, a non-operation waveform, and a non-ejection waveform.

The gray-scale controller 43 receives three types of driving signals (driving signal pulse_timing0 containing non-ejection waveform, driving signal pulse_timing1 containing non-operation waveform, and driving signal pulse_timing2 containing ejection waveform) from the driving signal generation circuit 18. FIG. 6 is a view illustrating output waveforms of the three types of driving signals. The driving signal pulse_timing0 containing non-ejection waveform is a signal maintained at a low level during a period of one count of the gray-scale count GSC. The driving signal pulse_timing2 containing ejection waveform is a signal which becomes a high level signal during a predetermined period in the period of one count of the gray-scale count GSC. The driving signal pulse_timing1 containing non-operation waveform is a signal which becomes a high level signal during a predetermined period in the period of one count of the gray-scale count GSC after the driving signal pulse_timing2 returns to a low level signal.

The register 46 provided on the gray-scale controller 43 stores a conversion table corresponding to information on a relationship between respective 3-bit pixel data, and driving waveform pattern data representing arrangement of a plurality of driving voltage patterns for driving the piezoelectric elements of the ink ejection mechanisms.

FIG. 7 is a view of the conversion table showing the pixel data and the driving waveform pattern data. The conversion table and the driving waveform pattern data contained therein are data for defining ink ejection timing in accordance with pixel data, as a mode of parameters (predetermined setting) stored in the register 46.

Driving waveform pattern data is written to the register 46 as input data regData via the input switch unit 47 in synchronization with the clock signal regCLK. On the other hand, driving waveform pattern data is read from the register 46 as reading data regOutO via the output switch unit 48 in synchronization with the clock signal regCLK. The input switch unit 47 includes a switching element which switches input of an input signal between input to the shift register 41, or input to circuit elements for writing and reading to and from the register 46, in accordance with the enable signal regEN. The output switch unit 48 includes a switching element which switches output between output from the shift register 41 and output from any one of the circuit elements for writing and reading to and from the register 46, in accordance with the enable signal regEN. The circuit elements for writing and reading to and from the register 46 include the register 46, an exclusive OR circuit 51, an AND circuit 53, and an OR circuit 54 illustrated in FIG. 9. While the one input switch unit 47 and the one output switch unit 48 are shown in FIG. 5, each of the input switch unit 47 and the output switch unit 48 actually contains a plurality of switches (see FIG. 9). FIG. 5 does not show connection between the foregoing circuit elements and the input switch unit 47 and the output switch unit 48. A range indicated by a broken-line frame in FIG. 5, i.e., a configuration of an input/output unit 49 containing the input switch unit 47 and the output switch unit 48, and writing and reading of data to and from the register 46 using the input/output unit 49 will be detailed later.

As noted above, pixel data contains 3-bit and 8-gradation data. Accordingly, pixel data is represented as (0, 0, 0) to (1, 1, 1) in the conversion table in FIG. 7. Driving waveform pattern data is data representing arrangement of 8 driving waveforms corresponding to the respective gray-scale counts GSC (0 to 7), and has three values of 0, 1, and 2. For example, driving waveform pattern data (1, 1, 2, 2, 2, 2, 2, 0) is selected for pixel data (1, 0, 1). Each of the values 0, 1, and 2 corresponding to the values of driving waveform pattern data indicates selection of driving signal pulse_timing0, driving signal pulse_timing1, and driving signal pulse_timing2, respectively, during the period of one count of the gray-scale count GSC. Accordingly, for pixel data (1, 0, 1), driving signals are selected in the order of driving signal pulse_timing0, driving signal pulse_timing2, driving signal pulse_timing2, driving signal pulse_timing2, driving signal pulse_timing2, driving signal pulse_timing2, driving signal pulse_timing1, and driving signal pulse_timing1 from the gray-scale count GSC=0 side, to generate a selection signal representing a driving voltage pattern as a connection of corresponding driving signals.

As discussed herein, the gray-scale controller 43 generates a selection signal representing a driving voltage pattern as a combination of driving waveform pattern data selected based on pixel data and the three types of driving signals, and outputs the generated selection signal to the buffer amplifier 44. The selection signal output from the gray-scale controller 43 based on pixel data is a mode of output data defining driving operation associated with an ink ejection amount. On the other hand, the pixel data is a mode of input data associated with setting of this output data, as a mode of input data defining driving operation associated with the ink ejection amount.

When the nozzles in the group A are driven based on the nozzle group selection signal STB-1 in correspondence with n=1 in STB-n shown in FIG. 7, the driving waveform pattern data corresponding to pixel data (0, 0, 0) to (1, 1, 1) is selected for the nozzles of the group A. In this case, driving waveform pattern data (1, 1, 1, 1, 1, 1, 1, 0) is selected for the nozzles of the group B and group C corresponding n=2 and 3 regardless of pixel data. Similar selections are made when the nozzles in the group B are driven based on the nozzle group selection signal STB-2 (n=2), and when the nozzles in the group C are driven based on the nozzle group selection signal STB-3 (n=3).

For the terminal out-D of the dummy channel, driving waveform pattern data (1, 1, 1, 1, 1, 1, 1, 0) is always selected.

When the gray-scale count GSC is 0, "0" (non-ejection waveform) is set as a value of driving waveform pattern data for all of the driving waveform pattern data.

The buffer amplifier 44 generates a driving voltage pattern at a level shifted to a voltage level necessary for driving the piezoelectric element of the ink ejection mechanism based on the selection signal received from the gray-scale controller 43.

Figure 8:
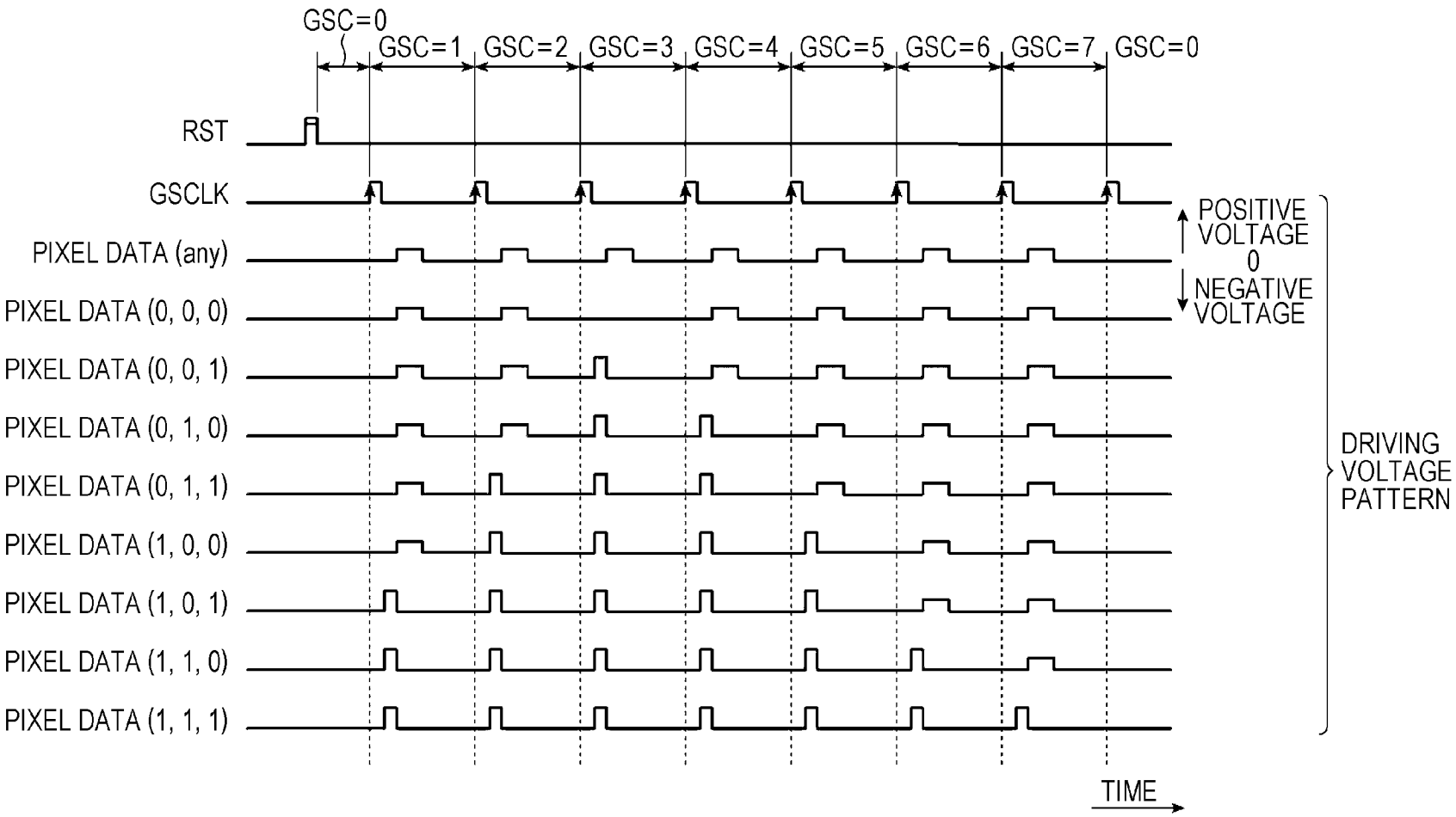
FIG. 8 is a view illustrating patterns of driving voltage supplied from a buffer amplifier.

FIG. 8 illustrates driving voltage patterns to be output to the piezoelectric element of the ink ejection mechanism from the buffer amplifier 44.

The voltage VH1 and the voltage VH2 have been supplied to the buffer amplifier 44 via an input terminal. As illustrated in a lower part of FIG. 6, the buffer amplifier 44 supplies the voltage VH1 to the piezoelectric element of the ink ejection mechanism when the driving signal pulse_timing2 containing ejection waveform becomes a high level signal, supplies the voltage VH2 lower than the voltage VH1 to the piezoelectric elements of the ink ejection mechanism when the driving signal pulse_timing1 containing non-operation waveform becomes a high level signal, and supplies the reference voltage (GND) to the piezoelectric elements of the ink ejection mechanism during the period when both the driving signals pulse_timing1 and pulse_timing2 become low-level signals, or the period when the driving signal pulse_timing0 has been selected, based on the two selection signals for each channel input from the gray-scale controller 43. As a result, driving voltage patterns containing the ejection waveform constituted by the voltage VH1 and GND, the non-operation waveform constituted by the voltage VH2 and GND, and the non-ejection waveform constituted by the reference voltage (GND) are generated in accordance with respective pixel data, and supplied to the piezoelectric elements of the corresponding ink ejection mechanisms. In response to supply of these driving voltage patterns, ink is ejected from the corresponding ink ejection mechanisms in accordance with the supplied driving voltage patterns.

Specific operation control for the groups A to group C of the nozzle arrays 22 is performed as follows. The nozzle group selection signals STB-1, STB-2, and STB-3 as input signals are set to high level in this order, so that the group A, group B, and group C can be selected during the selection periods of the nozzle group selection signals STB-1, STB-2, and STB-3, respectively, based on the high-level state of the respective signals. In each of these selection periods, the counter 45 counts up the gray-scale count GSC from 0 to 7. Then, driving waveform pattern data corresponding to the pixel data (0, 0, 0) to (1, 1, 1) in FIG. 8 is selected for the selected group of the nozzle array 22, and driving waveform pattern data of (1, 1, 1, 1, 1, 1, 1, 0) of pixel data (any) in FIG. 8 is selected for the not selected group of the nozzle array 22 regardless of the pixel data. When the gray-scale count GSC reaches 7, the gray-scale count GSC is reset based on the reset signal RST, whereafter the subsequent nozzle group selection signal STB-n is selectively set to high level. By this method, driving voltage patterns are sequentially supplied to the piezoelectric elements of the ink ejection mechanisms in the order of the group A to group C. The ejection operation illustrated in FIGS. 3A through 3C is thus achievable in the order of the group A to the group C.

<Configuration Associated with Data Writing and Reading to and from Register>

According to this embodiment, the register 46 is provided on each of the plurality of driving circuits 23 included in each of the driving units 21. For allowing operation of the respective driving circuits 23 based on identical settings, identical data needs to be written to each of the registers 46 of the driving circuits 23.

Accordingly, data stored in each of the registers 46 is read and compared so as to confirm that identical data has been written to each of the registers 46.

A configuration for data writing and reading to and from each of the registers 46 is hereinafter described.

Figure 9:
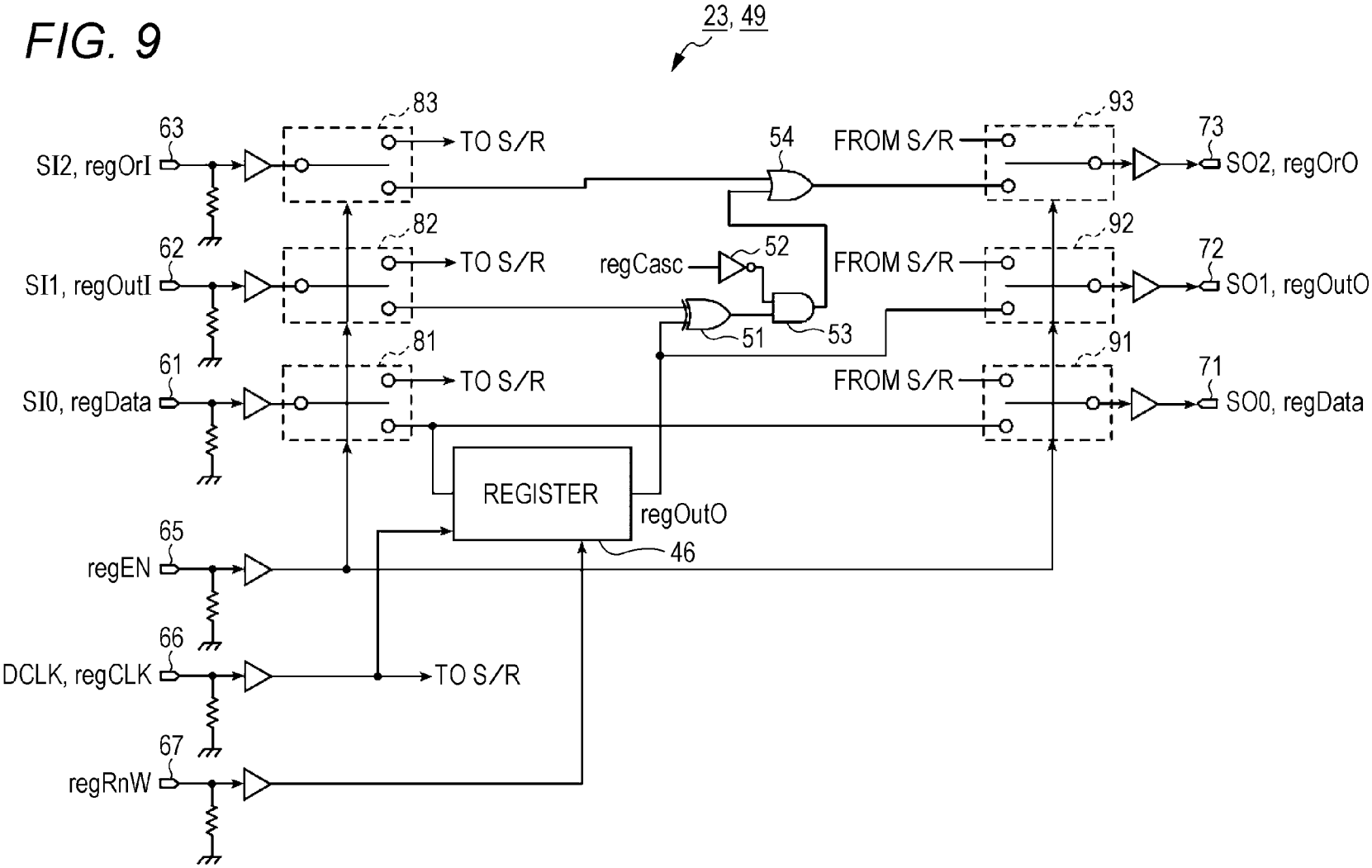
FIG. 9 is a view illustrating an input/output unit of the driving circuit.

FIG. 9 is a view illustrating the input/output unit 49 of one of the driving circuits 23.

Input units 61, 62, and 63 are electrically connected with switches 81, 82, and 83 (input switch unit 47 as input switch unit) via buffers. The switches 81, 82, and 83 switch connection destinations of the input units 61, 62, and 63 in accordance with the enable signal regEN input to an input unit 65. More specifically, the switches 81, 82, and 83 connect the input units 61, 62, and 63 to the shift register 41 when the enable signal regEN is negated (at low level). When the enable signal regEN is asserted (at high level), the switch 81 connects the input unit 61 to the input of the register 46 and a switch 91. Simultaneously, the switch 82 connects the input unit 62 to one of the inputs of the exclusive OR circuit 51, and the switch 83 connects the input unit 63 to one of the inputs of the OR circuit 54.

The output of the register 46 is connected with the other input of the exclusive OR circuit 51 and a switch 92. The output of the exclusive OR circuit 51 is connected with one of the inputs of the AND circuit 53. The other input of the AND circuit 53 is connected with the output of an inverting circuit 52 to which the setting signal regCasc is input. The output of the AND circuit 53 is connected with the other input of the OR circuit 54. The output of the OR circuit 54 is connected with a switch 93.

The switches 91, 92, and 93 (output switch unit 48 as output switch unit) are electrically connected with the output units 71, 72, and 73, respectively, via buffers. The switches 91, 92, and 93 switch connection destinations of the output units 71, 72, and 73 in accordance with the enable signal regEN input to the input unit 65. More specifically, the switches 91, 92, and 93 connect the output units 71, 72, and 73 to the shift register 41 when the enable signal regEN is negated (at low level). When the enable signal regEN is asserted (at high level), the switch 91 connects the output unit 71 to the switch 81 and the input of the register 46. Simultaneously, the switch 92 connects the output unit 72 to the output of the register 46 and the input of the exclusive OR circuit 51, and the switch 93 connects the output unit 73 to the output of the OR circuit 54.

The output units 71, 72, and 73 of the first stage driving circuit 231Y are electrically connected with the input units 61, 62, and 63 of the second stage driving circuit 232Y, respectively. The output units 71, 72, and 73 of the second stage driving circuit 232Y are electrically connected with the input units 61, 62, and 63 of the third driving circuit 233Y, respectively. The output units 71, 72, and 73 of the third stage driving circuit 233Y are electrically connected with the input units 61, 62, and 63 of the fourth stage driving circuit 234Y.

According to this embodiment, the input units 61 of the first stage driving circuit 231Y to the fourth stage driving circuit 234Y correspond to a first stage setting information input unit (first setting information input unit), a second stage setting information input unit (second setting information input unit), a third stage setting information input unit (third setting information input unit), and a fourth stage setting information input unit (fourth setting information input unit), respectively. The output units 71 of the first stage driving circuit 231Y to the third stage driving circuit 233Y correspond to a first stage setting information output unit (first setting information output unit), a second stage setting information output unit (second setting information output unit), and a third stage setting information output unit (third setting information output unit), respectively. The output units 72 of the first stage driving circuit 231Y to the third stage driving circuit 233Y correspond to a first stage setting output unit (first setting output unit), a second stage setting output unit (second setting output unit), and a third stage setting output unit (third setting output unit), respectively. The input units 62 of the second stage driving circuit 232Y to the fourth stage driving circuit 234Y correspond to a second stage setting input unit (second setting input unit), a third stage setting input unit (third setting input unit), and a fourth stage setting input unit (fourth setting input unit), respectively. The output units 73 of the first stage driving circuit 231Y to the fourth stage driving circuit 234Y correspond to a first stage result output unit (first result output unit), a second stage result output unit (second result output unit) (or a second stage accumulated comparison result output unit (second accumulated comparison result output unit)), a third stage accumulated comparison result output unit (third accumulated comparison result output unit), and a fourth stage accumulated comparison result output unit (fourth accumulated comparison result output unit), respectively. The input units 63 of the second stage driving circuit 232Y to the fourth stage driving circuit 234Y correspond to a second stage result input unit (second result input unit), a third stage result input unit (third result input unit), and a fourth stage result input unit (fourth result input unit), respectively. Parts including the exclusive OR circuits 51 and the AND circuits 53 in the first stage driving circuit 231Y to the fourth stage driving circuit 234Y correspond to a first stage comparison unit (first comparison unit), a second stage comparison unit (second comparison unit), a third stage comparison unit (third comparison unit), and a fourth stage comparison unit (fourth comparison unit), respectively.

According to this embodiment, the output units 71 and 72 of the fourth stage driving circuit 234Y at the final stage may be eliminated.

The input unit 66 receives a clock signal at a predetermined frequency, and outputs the signal to the corresponding shift register 41 as the transfer clock signal DCLK associated with transfer of the pixel data, and to the register 46 as the clock signal regCLK associated with data writing and reading to and from the register 46.

The input unit 67 receives a writing/reading selection signal regRnW for allowing either writing and reading to and from the register 46, and outputs the signal to the register 46.

The register 46 may have an arbitrary configuration capable of receiving input data regData containing an address and data so as to write the data to a storage area corresponding to the address in response to input of the data regData, or capable of receiving an address so as to read data stored in a storage area corresponding to this address in response to input of the address. For example, the register 46 may be constituted by a memory device which includes a plurality of shift registers containing storage elements (such as 16-bit storage elements) arranged in a line for each address, and outputs (16-bit) data from the shift register in the line corresponding to an address at the time of input of this address. Alternatively, the register 46 may be a constituted by a memory device which decodes an input address using a decoder, and specifies the position of data for writing and reading based on the decoded information.

<Transfer of Pixel Data>

Operation of the driving circuit 23 at the time of transfer of pixel data is hereinafter described with reference to FIG. 9.

According to this embodiment, the enable signal regEN is negated at the time of transfer of pixel data, in which state the input units 61, 62, and 63 and the output units 71, 72, and 73 are connected to the shift register 41. More specifically, the switches 81, 82, and 83 switch the connection destinations of the input units 61, 62, and 63 to the shift register 41 corresponding to a predetermined circuit so as to store input data (pixel data) input to the input units 61, 62, and 63, i.e., input data (pixel data) for specifying driving operation associated with ink ejection amounts, in the shift register 41 corresponding to a predetermined storage unit. In this state, respective bit values SI0, SI1, and SI2 of 3-bit pixel data are input to the input units 61, 62, and 63 of the first stage driving circuit 231Y, and transferred in accordance with the transfer clock signal DCLK. Apart of the input pixel data is transferred to the subsequent driving circuit 23 as respective bit values SO0, SO1, and SO2.

<Data Writing to Register>

In writing data to the register 46, the enable signal regEN is asserted, in which state the input unit 61 and the output unit 71 are connected with the register 46. More specifically, the switches 81, 82, and 83 switches the connection destinations of the input units 61, 62, and 63 so as to use data input to the input units 61, 62, and 63 as data for writing predetermine settings to the register 46. In this state, input data regData (setting information) is input to the input unit 61 of the first stage driving circuit 231Y. The input data regData is constituted by data corresponding to driving waveform pattern data to be written, and an address of the writing destination.

FIG. 10 is a view illustrating driving waveform pattern data to be written to the register 46, and an address of this pattern data. Respective addresses and data associated with 10 pattern driving waveform pattern data are given No. 0 to No. 9 as illustrated in FIG. 10, and correspond to No. 0 to No. 9 driving waveform pattern data in the conversion table shown in FIG. 7.

In this case, 8-bit addresses (00000000) to (00001001) are set to the respective lines No. 0 to No. 9. Each of the driving waveform pattern data is represented by 16 bits. According to the driving waveform pattern data show in FIG. 10, 8 high-order bits (1st bits), representing driving waveform pattern data in binary numbers and each constituted by any number of "0 to 2", are allocated to 15th bit to 08th bit, while low-order bits (0th bits) in binary numbers are allocated to 07th bit to 00th bit. For example, binary numbers corresponding to driving waveform pattern data (1, 1, 2, 2, 2, 2, 2, 0) for pixel data (1, 0, 1) are (01, 01, 10, 10, 10, 10, 10, 00). In this case, high-order bits (00111110) representing this driving waveform pattern data in binary numbers are allocated to 15th bit to 08th bit of the driving waveform pattern data at an address (00000101) of the pixel data (1, 0, 1), while low-order bits (11000000) are allocated to 07th bit to 00th bit at the same address.

Figure 11:
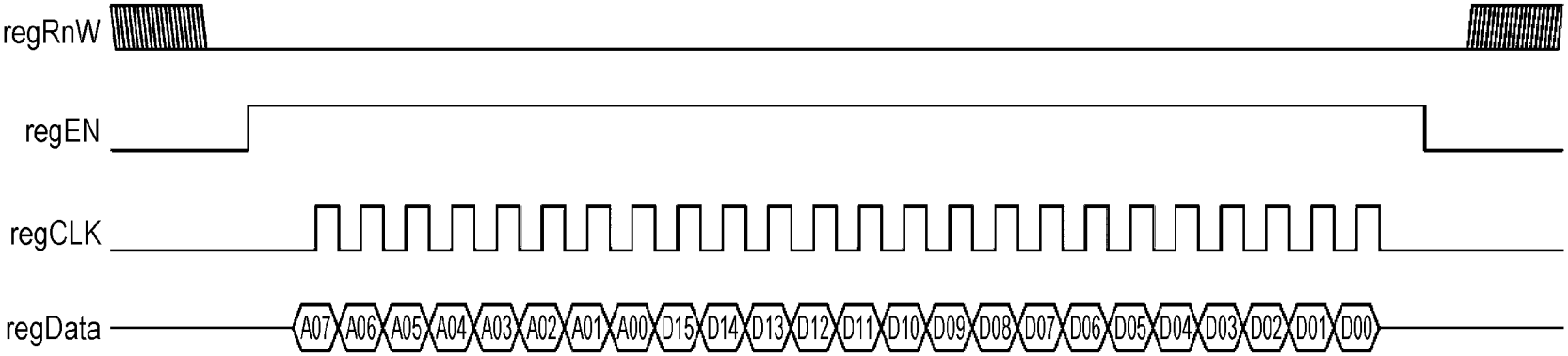
FIG. 11 is a timing chart showing a sequence for data writing to the register.
Figure 12:
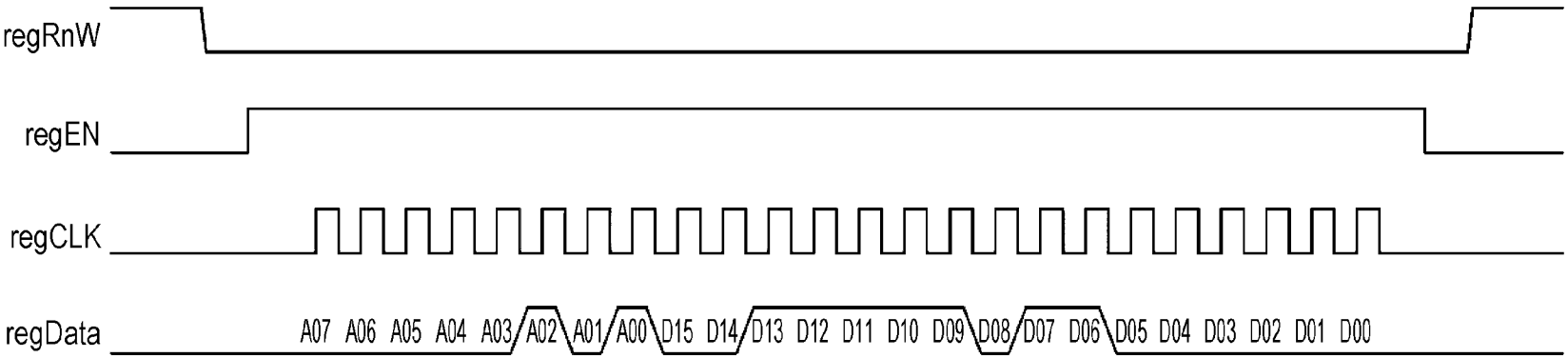
FIG. 12 is a timing chart showing an example of writing of driving waveform pattern data.

FIG. 11 is a timing chart showing a sequence for writing data to the register 46. FIG. 12 is a timing chart showing an example of the writing sequence for writing driving waveform pattern data (0011111011000000) to the address (00000101).

The writing/reading selection signal regRnW is a signal for designating selection of writing operation to the register 46, or reading operation from the register 46. When the writing/reading selection signal regRnW is a low level signal, the register 46 comes into a writing mode for writing operation. When the writing/reading selection signal regRnW is a high level signal, the register 46 comes into a reading mode for reading operation. A section of the register 46 for performing a function of switching operation between writing and reading based on the writing/reading selection signal regRnW corresponds to a reading/writing switch unit. In the input data regData, A07 to A00 represent an address to which data is written, while D15 to D00 represent respective data of 15th bit to 00th bit of driving waveform pattern data to be written.

Data writing to the register 46 is achieved by input of input data regData to the register 46, as data containing an address and data in this order, in synchronization with the clock signal regCLK after a change of the writing/reading selection signal regRnW to a low level signal and a change of the enable signal regEN to a high level signal.

In this state, the enable signal regEN is at high level in FIG. 9, wherefore the input unit 61 of the first stage driving circuit 231Y is electrically connected with the input of the register 46 and the output unit 71. In response to input of the input data regData to the input unit 61, the input data regData is sequentially written to the register 46 of the first stage driving circuit 231Y, and also output from the output unit 71 and input to the input unit 61 of the subsequent second stage driving circuit 232Y.

The high-level enable signal regEN is input to all the four driving circuits 23, wherefore the input units 61 and the output units 71 of all the driving circuits 23 come into the foregoing connection state. Accordingly, the input unit 61 of the first stage driving circuit 231Y is connected with the input unit 61 and the register 46 of the second stage driving circuit 232Y via the output unit 71, and similarly connected with the input units 61 and the registers 46 of the third stage driving circuit 233Y and the fourth stage driving circuit 234Y. This condition allows simultaneous writing of driving waveform pattern data to designated addresses of the registers 46 of the four driving circuits 23 as a result of input of the input data regData to the input unit 61 of the first stage driving circuit 231Y. These processes are performed for the addresses (00000000) to (00001001) corresponding to all the driving waveform pattern data, so that the driving waveform pattern data can be written to the registers 46 of all the driving circuits 23.

<Data Reading from Register>

Operation for data reading from the register 46 is hereinafter described.

Figure 13:
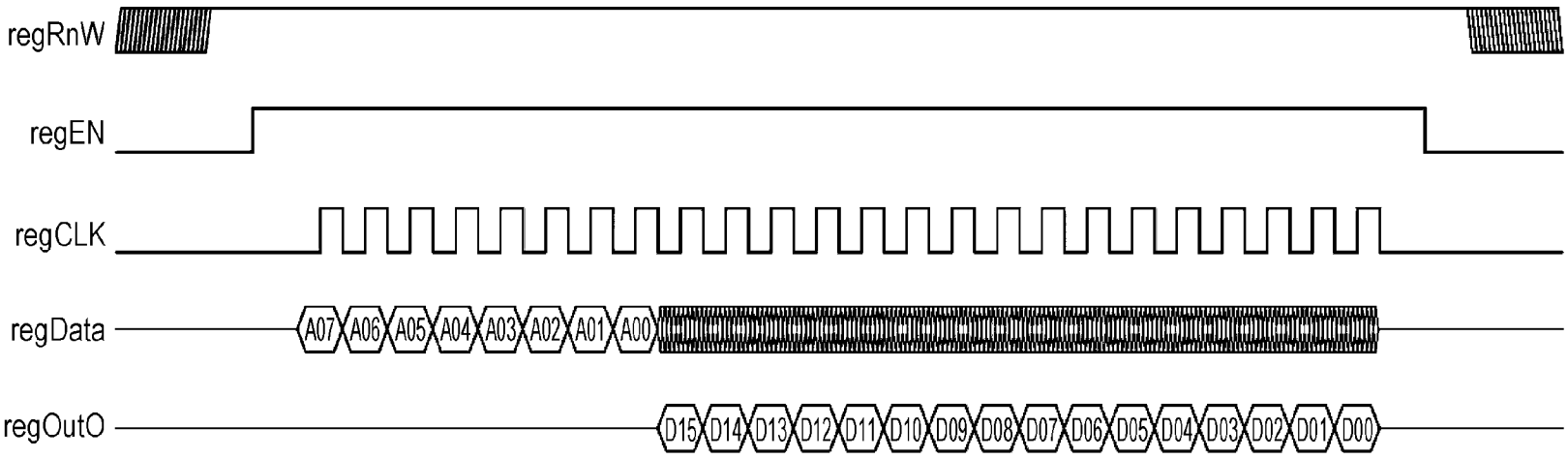
FIG. 13 is a timing chart showing a sequence for data reading from the register.

FIG. 13 is a timing chart showing a sequence for reading driving waveform pattern data from the register 46.

Similarly to above, the enable signal regEN is asserted in reading data from the register 46. As a result, for all of the four driving circuits 23, the input unit 61 is connected with the input of the register 46 and the switch 91, while the input unit 62 is connected with one of the inputs of the exclusive OR circuit 51. Simultaneously, the input unit 63 is connected with one of the inputs of the OR circuit 54, while the output unit 71 is connected with the switch 81 and the input of the register 46. Furthermore, the output unit 72 is connected with the output of the register 46 and the input of the exclusive OR circuit 51, while the output unit 73 is connected with the output of the OR circuit 54. In other words, the switches 81, 82, and 83 switch the connection destinations of the input units 61, 62, and 63 to use data input to the input units 61, 62, and 63 as data for reading predetermined settings from the register 46.

Reading of the driving waveform pattern data from the register 46 is achieved by input of input data regData (setting information) to the register 46, as data containing an address of data for reading, in synchronization with the clock signal regCLK after a change of the writing/reading selection signal regRnW to a high level signal and a change of the enable signal regEN to a high level signal. After completion of input of the 8-bit address by input of the input data regData, reading data regOutO which indicates 16-bit driving waveform pattern data corresponding to this address is output from the output of the register 46 from the subsequent clock timing.

When input data regData containing the address of the reading data is input to the input unit 61 of the first stage driving circuit 231Y, the input data regData is input to the register 46 of the first stage driving circuit 231Y, and also to the input units 61 and the registers 46 of the second stage driving circuit 232Y, the third stage driving circuit 233Y, and the fourth stage driving circuit 234Y. Accordingly, the address of the reading data is simultaneously input to the respective registers 46 of the four driving circuits 23. Subsequently, driving waveform pattern data at the address thus input is simultaneously read from the respective registers 46 as reading data regOutO.

According to this embodiment, driving waveform pattern data is simultaneously read from the respective registers 46 in one reading sequence in this manner, whereafter it is confirmed whether or not the driving waveform pattern data read from the respective registers 46 agree with each other in the one reading sequence. Operation associated with confirmation of agreement between data is hereinafter described.

As illustrated in FIG. 9, the reading data regOutO read from the register 46 is output from the output unit 72, and input to the input unit 62 of the subsequent driving circuit 23 as reading data regOutI. The reading data regOutO is also input to one of the inputs of the exclusive OR circuit 51. Accordingly, the subsequent stage exclusive OR circuit 51 simultaneously receives the reading data regOutI from the preceding stage and the reading data regOutO of the current stage, compares the respective bit values to confirm agreement between these values, and outputs a comparison result. The exclusive OR circuit 51 of the first stage driving circuit 231Y at the head is allowed to receive an arbitrary signal at the other input. This arbitrary signal is a mode of predetermined reference data input to the first stage comparison unit (first comparison unit) of the first stage driving circuit 231Y.

The AND circuit 53 receives output from the exclusive OR circuit 51, and an inversion signal of the setting signal regCasc. As noted above, the setting signal regCasc input to the first stage driving circuit 231Y at the head is "H", wherefore "L" is input to the AND circuit 53. In other words, the setting signal regCasc input to the first stage driving circuit 231Y is a signal defining output from the AND circuit 53 as false. Accordingly, "L" is always output as a comparison result from the AND circuit 53 of the first stage driving circuit 231Y regardless of output from the exclusive OR circuit 51. The output "L" is input to the OR circuit 54.

On the other hand, the setting signal regCasc input to each of the subsequent second stage driving circuit 232Y to fourth stage driving circuit 234Y is "L", wherefore "H" is input to the AND circuit 53. Accordingly, when a comparison result at the exclusive OR circuit 51 shows a different value, i.e., when the output therefrom is "H", "H" is output from the AND circuit 53 as a comparison result, and input to the OR circuit 54. When the comparison result at the exclusive OR circuit 51 shows an identical value, i.e., when the output therefrom is "L", "L" is output from the AND circuit 53 as a comparison result, and input to the OR circuit 54.

The OR circuit 54 outputs the OR of the output from the AND circuit 53 and the signal from the input unit 63. The output from the OR circuit 54 is output as accumulated comparison data regOrO via the output unit 73, and input to the input unit 63 of the subsequent driving circuit 23 as accumulated comparison data regOrI. In this case, the input unit 63 of the first stage driving circuit 231Y always receives "L" as the accumulated comparison data regOrI, wherefore the OR circuit 54 always outputs "L". Accordingly, "H" is accumulatively output from the OR circuits 54 of the second stage driving circuit 232Y to the fourth stage driving circuit 234Y for bit data for which "H" has been input from the AND circuits 53 of these driving circuits 23. On the other hand, output of "L" is maintained for bit data for which "H" has never been input.

Accordingly, a bit containing difference (error) in any of driving waveform pattern data stored in the four registers 46 is detectable based on detection of accumulated comparison data regOrO output from the fourth stage driving circuit 234Y as the final stage.

Accordingly, agreement between driving waveform pattern data stored in the registers 46 of all the driving circuits 23 is confirmable by a series of this reading sequence performed for each of the addresses (00000000) to (00001001) corresponding to all the driving waveform pattern data.

The reading sequence may be performed only for a part of the respective addresses (00000000) to (00001001). This method allows detection of agreement only for a desired part contained in the driving waveform pattern data.

The input unit 63 of the second stage driving circuit 232Y always receives "L" as the accumulated comparison data regOrI, wherefore the output unit 73 of the second stage driving circuit 232Y outputs output (comparison result) of the AND circuit 53 as it is. Accordingly, the output unit 73 of the second stage driving circuit 232Y corresponds to the second stage accumulated comparison result output unit (second accumulated comparison result output unit) which outputs the accumulated comparison result obtained by accumulating the comparison result of the exclusive OR circuit 51 and the AND circuit 53 (second stage comparison unit (second comparison unit)) and the accumulated comparison data regOrI from the first stage driving circuit 231Y. In addition, the output unit 73 of the second stage driving circuit 232Y corresponds to the second stage result output unit (second result output unit) which outputs the comparison result of the second stage comparison unit.

The input unit 63 of the third stage driving circuit 233Y connected with the output unit 73 of the second stage driving circuit 232Y corresponds to the third stage accumulating comparison result input unit (third accumulated comparison result input unit) to which the accumulated comparison result from the second stage driving circuit 232Y is input, and also corresponds to the third stage result input unit (third result input unit) to which the comparison result obtained by the second stage comparison unit of the second stage driving circuit 232Y is input.

The output unit 73 of the third stage driving circuit 233Y corresponds to the third stage accumulated comparison result output unit (third accumulated comparison result output unit) which outputs the accumulated comparison result obtained by accumulating the comparison result of the exclusive OR circuit 51 and the AND circuit 53 (third stage comparison unit (third comparison unit)), and the accumulated comparison data regOrI from the second stage driving circuit 232Y.

The input unit 63 of the fourth stage driving circuit 234Y connected with the output unit 73 of the third stage driving circuit 233Y corresponds to the fourth stage accumulating comparison result input unit (fourth accumulated comparison result input unit) to which the accumulated comparison result from the third stage driving circuit 233Y is input.

As noted above, the output of the exclusive OR circuit 51 is output from the output unit 73 of the second stage driving circuit 232Y as it is according to this embodiment. Accordingly, the output of the exclusive OR circuit 51 of the second stage driving circuit 232Y may be configured to connect with the output unit 73 via the switch 93.

Figure 14:
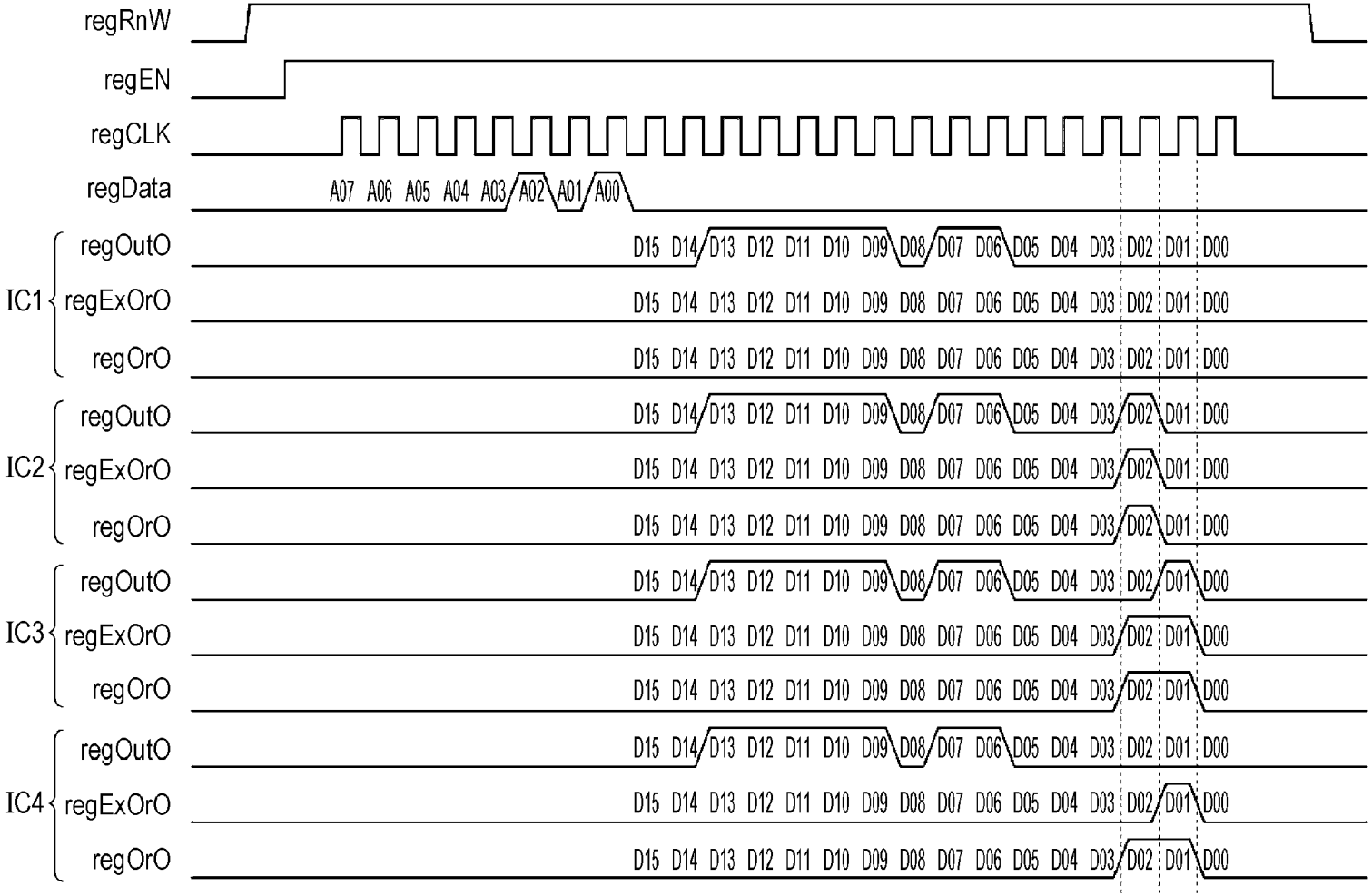
FIG. 14 is a timing chart showing an example of reading of driving waveform pattern data.

FIG. 14 is a timing chart showing an example of a reading sequence executed in reading driving waveform pattern data (0011111011000000) designated by the address (00000101) in FIG. 10. FIG. 14 shows input data regData input to the first stage driving circuit 231Y, and reading data regOutO, exclusive OR output regExOrO, and accumulated comparison data regOrO output from each of the first stage driving circuit 231Y (IC1), the second stage driving circuit 232Y (IC2), the third stage driving circuit 233Y (IC3), and the fourth stage driving circuit 234Y (IC4). The exclusive OR output regExOrO is an output signal from the exclusive OR circuit 51 (or AND circuit 53) shown in FIG. 9.

When receiving input data regData containing an 8-bit address (00000101), the registers 46 of the respective driving circuits 23 output reading data regOutO containing 16-bit driving waveform pattern data (0011111011000000) from the subsequent clock timing. It is assumed herein that error data (0011111011000100) containing "H" at D02 is read from the second stage driving circuit 232Y, and that error data (0011111011000010) containing "H" at D01 is read from the third stage driving circuit 233Y, in the state that correct data is read from the first stage driving circuit 231Y and the fourth stage driving circuit 234Y.

The exclusive OR output regExOrO and the accumulated comparison data regOrO of the first stage driving circuit 231Y always become "L" as discussed above.

The exclusive OR output regExOrO of the second stage driving circuit 232Y becomes "H" at the time of reading of the bit at D02 in the reading data regOutO. This situation occurs based on the correct "L" reading data regOutI from the first stage driving circuit 231Y, and the error "H" reading data regOutO from the second stage driving circuit 232Y, both the "L" data regOutI and The "H" reading data regOutO input to the exclusive OR circuit 51 at the corresponding timing. Accordingly, the accumulated comparison data regOrO becomes "H" at the time of reading of the bit at D02.

The exclusive OR output regExOrO of the third stage driving circuit 233Y becomes "H" at the time of reading of the bits at D02 and D01 in the reading data regOutO. This situation occurs based on the error "H" reading data regOutI from the second stage driving circuit 232Y, and correct "L" reading data regOutO from the third stage driving circuit 233Y, both the "H" data regOutI and the "L" reading data regOutO input to the exclusive OR circuit 51 at the time of reading of the bit at D02, and based on the correct "L" reading data regOutI from the second stage driving circuit 232Y, and the error "H" reading data regOutO from the third stage driving circuit 233Y, both the "L" data regOutI and the "H" reading data regOutO input to the exclusive OR circuit 51 at the time of reading of the bit at D01. The accumulated comparison data regOrO becomes "H" at the time of reading of the bits at D02 and D01. This situation occurs based on output of the accumulated comparison data regOrO which corresponds to the OR of the accumulated comparison data regOrI as a signal input to the third stage driving circuit 233Y and indicating the accumulated comparison data regOrO up to the second stage driving circuit 232Y containing the bit "H" at D02 (exclusive OR output regExOrO at the second stage driving circuit 232Y), and the exclusive OR output regExOrO of the third stage driving circuit 233Y containing the bits "H" at D01 and D02. Accordingly, the accumulated comparison data regOrO is data accumulating comparison results of bits showing different driving waveform pattern data in the first stage driving circuit 231Y to the third stage driving circuit 233Y.

The exclusive OR output regExOrO of the fourth stage driving circuit 233Y becomes "H" at the time of reading of the bit at D01 in the reading data regOutO. This situation occurs based on the error "H" reading data regOutI from the third stage driving circuit 233Y, and the correct "L" reading data regOutO from the fourth stage driving circuit 234Y, both the "H" data regOutI and the "L" reading data regOutO input to the exclusive OR circuit 51 at the time of reading of the bit at D01. The accumulated comparison data regOrO represents the OR of the accumulated comparison data regOrI as a signal input to the fourth stage driving circuit 234Y and corresponding to the accumulated comparison data regOrO up to the third stage driving circuit 233Y, and the exclusive OR output regExOrO of the fourth stage driving circuit 234Y. The accumulated comparison data regOrO becomes "H" at the time of reading of the bits at D02 and D01. Accordingly, the accumulated comparison data regOrO is data accumulating comparison results of the bits showing different driving waveform pattern data in the first stage driving circuit 231Y to the fourth stage driving circuit 234Y.

As described herein, it is detectable at the register 46 of any one of the driving circuits 23 that the reading data regOutO at each of the bits of D02 and D01 is error data, i.e., that error data has been written to the corresponding bits, based on the state that the accumulated comparison data regOrO of the fourth stage driving circuit 234Y becomes "H" at the time of reading of the bits at D02 and D01.

The inkjet recording apparatus 1 executes the foregoing sequences for writing and reading driving waveform pattern data to and from the register 46 at predetermined timing. Examples of this predetermined timing include timing of power supply to the inkjet recording apparatus 1, and timing prior to recording of driving waveform pattern data different from current driving waveform pattern data. The CPU 11 executes a writing program read from the ROM 13 at the timing noted above for writing to the register 46, and stores results in the ROM 13. Alternatively, the CPU 11 writes driving waveform pattern data input from the external device 4 in the register 46 of the corresponding driving circuit 23. Subsequently to the writing sequence, the CPU 11 executes the reading sequence for reading from the register 46. When the reading sequence detects data indicating disagreement between data read from the respective driving circuits 23 via wires connecting the driving unit 21K and the CPU 11 in the wires 19 illustrated in FIG. 1 (i.e., "H" signal of accumulated comparison data regOrO of the fourth stage driving circuit 234Y), the CPU 11 is allowed to re-execute the writing sequence using identical data.

When the register 46 is constituted by a non-volatile memory, the writing and reading sequences for driving waveform pattern data need not be executed for the register 46 at the time of power supply to the inkjet recording apparatus 1.

While the four driving circuits 23 are cascade-connected in each of the driving units 21 according to the embodiment discussed herein, the number of the driving circuits 23 is not limited to this number. For example, only the two driving circuits 23 corresponding to the first stage driving circuit 231Y and the second stage driving circuit 232Y may be cascade-connected. In this case, agreement between the driving waveform pattern data stored in the registers 46 of the two driving circuits 23 is confirmed by one reading sequence based on acquisition of the accumulated comparison data regOrO of the subsequent second stage driving circuit 232Y.

According to this configuration, the output units 71 and 72 of the second stage driving circuit 232Y at the final stage may be eliminated.

Alternatively, the number of the cascade-connected driving circuits 23 may be three, five, or a larger number. In case of configurations containing the three, five or more driving circuits 23, agreement between the driving waveform pattern data stored in the registers 46 of all the driving circuits 23 is confirmed by one reading sequence based on acquisition of the accumulated comparison data regOrO of the final stage driving circuit 23, similarly to the above configuration.

In the configurations containing the three, five or more driving circuits 23, the output units 71 and 72 of the driving circuit at the final stage may be eliminated similarly to the above configuration.

Discussed in this embodiment is a preferable mode in which the first stage driving circuit 231Y at the head stage to the fourth stage driving circuit 234Y at the final stage as the four driving circuits connected in series correspond to the first driving circuit, the second driving circuit, the third driving circuit, and the fourth driving circuit, respectively (units such as storage units and comparison units have similar correlations as noted above). However, the embodiment is not limited to this mode.

For example, this embodiment is applicable to a configuration which does not output reading data from the register 46 of the second stage driving circuit 232Y to the subsequent third stage driving circuit 233Y. In this case, each of the first stage driving circuit 231Y and the third stage driving circuit 233Y corresponds to the first driving circuit, while each of the second stage driving circuit 232Y and the fourth stage driving circuit 234Y corresponds to the second driving circuit. In any mode, two or more driving circuits in the order from the head correspond to the first driving circuit, the second driving circuit, and the further driving circuits, respectively, when the driving circuits contained in a plurality of driving circuits connected in series are continuously connected with the subsequent driving circuits such that reading data of the register 46 of the preceding stage driving circuit can be output to the subsequent driving circuit next to the preceding stage driving circuit for comparison between the reading data of the register 46 of the preceding driving circuit and the reading data of the register 46 of the subsequent stage.

As described above, the inkjet head 20 according to this embodiment includes the first stage driving circuit 231Y and the second stage driving circuit 232Y electrically connected with each other. The first stage driving circuit 231Y includes the register 46 that stores driving waveform pattern data as a predetermined setting, and the output unit 72 that reads at least a part of the driving waveform pattern data and outputs the read part as the reading data regOutO. The second stage driving circuit 232Y includes: the register 46 that stores driving waveform pattern data; the input unit 62 to which the reading data regOutI is input from the output unit 72 of the first stage driving circuit 231Y; the exclusive OR circuit 51 and the AND circuit 53 as the second stage comparison unit (second comparison unit) that compares the reading data regOutI input from the input unit 62, and data included in the driving waveform pattern data stored in the register 46 of the second stage driving circuit 232Y and corresponding to a part associated with the reading data regOutI; and the output unit 73 that outputs a comparison result output from the AND circuit 53. According to this configuration, agreement between data written to the registers 46 of the first stage driving circuit 231Y and the second stage driving circuit 232Y is easily recognizable based on detection of a signal output from the output unit 73 of the second stage driving circuit 232Y.

The inkjet head 20 according to this embodiment includes the third stage driving circuit 233Y electrically connected with the second stage driving circuit 232Y. The second stage driving circuit 232Y includes the output unit 72 that reads at least a part of the driving waveform pattern data stored in the register 46 and outputs the read part as the reading data regOutO. The third stage driving circuit 233Y includes: the register 46 that stores driving waveform pattern data; the input unit 62 to which the reading data regOutI is input from the output unit 72 of the second stage driving circuit 232Y; the input unit 63 to which a comparison result output from the output unit 73 of the second stage driving circuit 232Y is input; the exclusive OR circuit 51 and the AND circuit 53 as the third stage comparison unit (third comparison unit) that compares the reading data regOutI input from the input unit 62, and data included in the driving waveform pattern data stored in the register 46 of the third stage driving circuit 233Y and corresponding to a part associated with the reading data regOutI; and the output unit 73 that outputs the accumulated comparison result regOrO obtained by accumulating a comparison result output from the AND circuit 53 and a comparison result input from the input unit 63. According to this configuration, agreement between data written to the registers 46 of the first stage driving circuit 231Y, the second stage driving circuit 232Y, and the third stage driving circuit 233Y is easily recognizable based on detection of a signal output from the output unit 73 of the third stage driving circuit 233Y.

The third stage driving circuit according to this embodiment includes the output unit 72 that reads at least a part of the driving waveform pattern data stored in the register 46 and outputs the read part as the reading data regOutO. The inkjet head 20 further includes the fourth stage driving circuit 234Y electrically connected with the third stage driving circuit 233Y. The fourth stage driving circuit 234Y includes: the register 46 that stores driving waveform pattern; the input unit 62 to which the reading data regOutI is input from the output unit 72 of the third stage driving circuit 233Y; the input unit 63 to which the accumulated comparison result output from the output unit 73 of the third stage driving circuit 233Y is input as the accumulated comparison data regOrI; the exclusive OR circuit 51 and the AND circuit 53 as the fourth stage comparison unit (fourth comparison unit) that compares the reading data regOutI input from the input unit 62, and data included in the driving waveform pattern data stored in the register 46 and corresponding to a part associated with the reading data regOutI; and the output unit 73 that outputs the accumulated comparison data regOrO obtained by accumulating a comparison result output from the AND circuit 53 and the accumulated comparison data regOrI input from the input unit 63. According to this configuration, agreement between data written to the registers 46 of the first stage driving circuit 231Y to the fourth stage driving circuit 234Y is easily recognizable based on detection of a signal output from the output unit 73 of the fourth stage driving circuit 234Y.

In more general, the third stage driving circuit 233Y includes the output unit 72 that outputs at least a part of the driving waveform pattern data stored in the register 46 and outputs the read part as the reading data regOutO. The inkjet head 20 further includes (N−3) Mth stage driving circuit (s) (N: 4 or larger integer, M: integer, $4 \leq M \leq N$). The Mth stage driving circuit includes: the register 46 that stores driving waveform pattern data; the input unit 62 to which output of the output unit 72 of a (M−1)th stage driving circuit is input; the input unit 63 to which the accumulated comparison data regOrI is input as an accumulated comparison result from the output unit 73 of the (M−1)th stage driving circuit; the exclusive OR circuit 51 and the AND circuit 53 as an Mth stage comparison unit that compares the reading data regOutI input from the input unit 62, and data included in the driving waveform pattern data stored in the register 46 and corresponding to a part associated with the reading data regOutI; and the output unit 73 that accumulates and outputs a comparison result output from the AND circuit 53 and the accumulated comparison data regOrI input from the input unit 63. The Mth stage driving circuit is electrically connected with the (M−1)th stage driving circuit in series. According to this configuration, agreement between data written to the registers 46 of the respective driving circuits 23 is easily recognizable based on detection of a signal output from the output unit 73 of the final stage driving circuit 23 (Nth stage driving circuit).

The inkjet head 20 according to this embodiment includes the first stage driving circuit 231Y and the second stage driving circuit 232Y electrically connected with each other. The first stage driving circuit 231Y includes: the register 46 that stores driving waveform pattern data as a predetermined setting; the output unit 72 that reads at least a part of the driving waveform pattern data and outputs the read part as the reading data regOutO; the exclusive OR circuit 51 and the AND circuit 53 corresponding to the first stage comparison unit (first comparison unit) that compares the read part of the driving waveform pattern data stored in the register 46 and predetermined reference data; and the output unit 73 that outputs a comparison result as output from the AND circuit 53. The second stage driving circuit 232Y includes: the register 46 that stores driving waveform pattern data; the input unit 62 to which the reading data regOutI is input from the output unit 72 of the first stage driving circuit 231Y; the exclusive OR circuit 51 and the AND circuit 53 as the second stage comparison unit (second comparison unit) that compares the reading data regOutI input from the input unit 62, and data included in the driving waveform pattern data stored in the register 46 of the second stage driving circuit 232Y and corresponding to a part associated with the reading data regOutI; the input unit 63 to which output from the output unit 73 of the first stage driving circuit 231Y is input; and the output unit 73 that outputs the accumulated comparison data regOrO accumulating a comparison result output from the AND circuit 53 and the input from the input unit 63. According to this configuration, the second stage driving circuit 232Y accumulates and outputs a result of comparison between a part of the driving waveform pattern data and the predetermined reference data at the first stage driving circuit 231Y, and a comparison result of the second stage driving circuit 232Y. Accordingly, agreement between data written to the registers 46 of the first stage driving circuit 231Y and the second stage driving circuit 232Y is easily recognizable based on detection of a signal output from the output unit 73 of the second stage driving circuit 232Y.

The inkjet head 20 according to this embodiment includes the third stage driving circuit 233Y electrically connected with the second stage driving circuit 232Y. The second stage driving circuit 232Y includes the output unit 72 that reads at least a part of the driving waveform pattern data stored in the register 46 and outputs the read part as the reading data regOutO. The third stage driving circuit 233Y includes: the register 46 that stores driving waveform pattern data; the input unit 62 to which the reading data regOutI is input from the output unit 72 of the second stage driving circuit 232Y; the input unit 63 to which the accumulated comparison data regOrO output from the output unit 73 of the second stage driving circuit 232Y is input; the exclusive OR circuit 51 and the AND circuit 53 as the third stage comparison unit (third comparison unit) that compares the reading data regOutI input from the input unit 62, and data included in the driving waveform pattern data stored in the register 46 of the third stage driving circuit 233Y and corresponding to a part associated with the reading data regOutI; and the output unit 73 that outputs the accumulated comparison data regOrO accumulating a comparison result output from the AND circuit 53 and the accumulated comparison data regOrI input from the input unit 63. According to this configuration, agreement between data written to the registers 46 of the first stage driving circuit 231Y, the second stage driving circuit 232Y, and the third stage driving circuit 233Y is easily recognizable based on detection of a signal output from the output unit 73 of the third stage driving circuit 233Y.

The first stage driving circuit 231Y includes the input unit 61 to which the input data regData (setting information) containing an address of driving waveform pattern data is input, and the output unit 71 that outputs the input data regData. The second stage driving circuit 232Y includes the input unit 61 to which the input data regData output from the output unit 71 of the first stage driving circuit 231Y is input. A range of the reading data regOutO output from the output unit 72 of the first stage driving circuit 231Y is defined based on the input data regData. According to this configuration, the reading data regOutO corresponding to the driving waveform pattern data within the range defined based on the input data regData is simultaneously read from the registers 46 of the first stage driving circuit 231Y and the second stage driving circuit 232Y cascade-connected with each other. According to this configuration, agreement between data written to the registers 46 of the respective driving circuits 23 is easily recognizable by one reading sequence. These advantages are similarly provided when the third stage driving circuit 233Y or further driving circuits 23 are connected in series.

The inkjet head 20 further includes the reading/writing switch unit that allows switching between a writing mode for writing driving waveform pattern data to the registers 46 of the first stage driving circuit 231Y and the second stage driving circuit 232Y, and a reading mode for outputting the reading data regOutO from the registers 46. The input data regData contains driving waveform pattern data to be written in the writing mode. According to this configuration, writing and reading to and from the registers 46 are easily achievable. These advantages are similarly provided when the third stage driving circuit 233Y or further driving circuits 23 are connected in series.

The inkjet head 20 further includes the input switch unit 47 (switches 81, 82, and 83) that switches output of the input data regData input to the first stage driving circuit 231Y, between output of the input data regData to the registers 46 of the first stage driving circuit 231Y and the second stage driving circuit 232Y as the input data regData associated with output of the driving waveform pattern data writing or reading data regOutO, and output of the input data regData to the shift register 41 corresponding to a predetermined storage unit as input data (pixel data) for defining driving operation associated with an amount of ink ejection. According to this configuration, the input units 61, 62, and 63 of the respective driving circuits 23 are used for both the purposes of writing and reading of driving waveform patterns to and from the register 46, and of storage of the input data (pixel data) in the shift register 41. Accordingly, the number of terminals of the driving circuits 23 can be decreased. These advantages are similarly provided when the third stage driving circuit 233Y or further driving circuits 23 are connected in series.

The exclusive OR circuit 51 and the AND circuit 53 as the second stage comparison unit (second comparison unit) of the second stage driving circuit 232Y compares data for comparison by a predetermined unit of data. According to this configuration, agreement between data written to the registers 46 of the respective driving circuits 23 is easily recognizable for each part of the predetermined unit of data in the driving waveform pattern data.

Particularly, the predetermined unit of data according to this embodiment is set to one bit. According to this configuration, agreement between data written to the registers 46 of the respective driving circuits 23 is easily recognizable for each bit in the driving waveform pattern data.

These advantages are similarly provided when the third stage driving circuit 233Y or further driving circuits 23 are connected in series.

The output unit 73 of the second stage driving circuit as a second stage accumulated comparison result output unit (second accumulate comparison result output unit), and the output unit 73 of the third stage driving circuit as a third stage accumulated comparison result output unit (third accumulate comparison result output unit) accumulate and output comparison results each containing different contents of the data compared by the predetermined unit of data. According to this configuration, a plurality of comparison results compared by the predetermined unit of data are accumulated, and output as the accumulated comparison data regOrO from the output unit 73 of the third stage driving circuit. Accordingly, the plurality of comparison results compared by the predetermined unit of data are collectively obtained based on detection of output from the output unit 73 of the second stage driving circuit 232Y or the output unit 73 of the third stage driving circuit 233Y. These advantages are similarly provided when the fourth stage driving circuit 234Y or further driving circuits 23 are connected in series.

The second stage comparison unit (second comparison unit) of the second stage driving circuit 232Y includes the exclusive OR circuit to which the reading data regOutI input from the input unit 62, and data included in the driving waveform pattern data stored in the register 46 of the current stage and corresponding to a part associated with the reading data regOutI are input. According to this configuration, output from the exclusive OR circuit becomes high level output (true) only when the two input reading data regOutI and reading data regOutO are different. Accordingly, agreement or disagreement between the reading data regOutI and the reading data regOutO from the registers 46 of the preceding stage and the current stage, respectively, is recognizable by using the exclusive OR circuit 51. These advantages are similarly provided when the third stage driving circuit 233Y or further driving circuits 23 are connected in series.

The first stage comparison unit (first comparison unit) of the first stage driving circuit 231Y includes the exclusive OR circuit 51 that receives predetermined reference data and the reading data regOutO from the register 46, and the AND circuit 53 that has inputs one of which receives output from the exclusive OR circuit 51. A signal that defines output from the AND circuit 53 as false is input to the other input of the AND circuit 53. The first stage comparison unit (first comparison unit) obtains output from the AND circuit 53 as a comparison result. According to this configuration, a value indicating that no error data is contained is output from the AND circuit 53 regardless of the value of the reading data regOutO from the register 46 of the first stage driving circuit 231Y. This configuration allows the use of the same chips for the first stage driving circuit 231Y and for the second stage driving circuit 232Y to the fourth stage driving circuit 234Y (or the Nth stage driving circuit), wherefore productivity increases.

According to this embodiment, the predetermined setting is driving waveform pattern data that defines driving operation associated with the amount of ink ejection. According to this configuration, disagreement between driving waveform pattern data written to the registers 46 of the respective driving circuits 23 is easily detectable.

The inkjet recording apparatus 1 according to this embodiment includes the inkjet head 20 having the foregoing configurations, wherefore agreement between data written to the registers 46 of the respective driving circuits 23 is easily recognizable.

Modified examples of the inkjet recording apparatus 1 and the inkjet head 20 according to this embodiment are hereinafter described. Each of the following modified examples may be combined with the foregoing embodiment, or may be combined with any one of the other modified examples.

Modified Example 1

Figure 15:
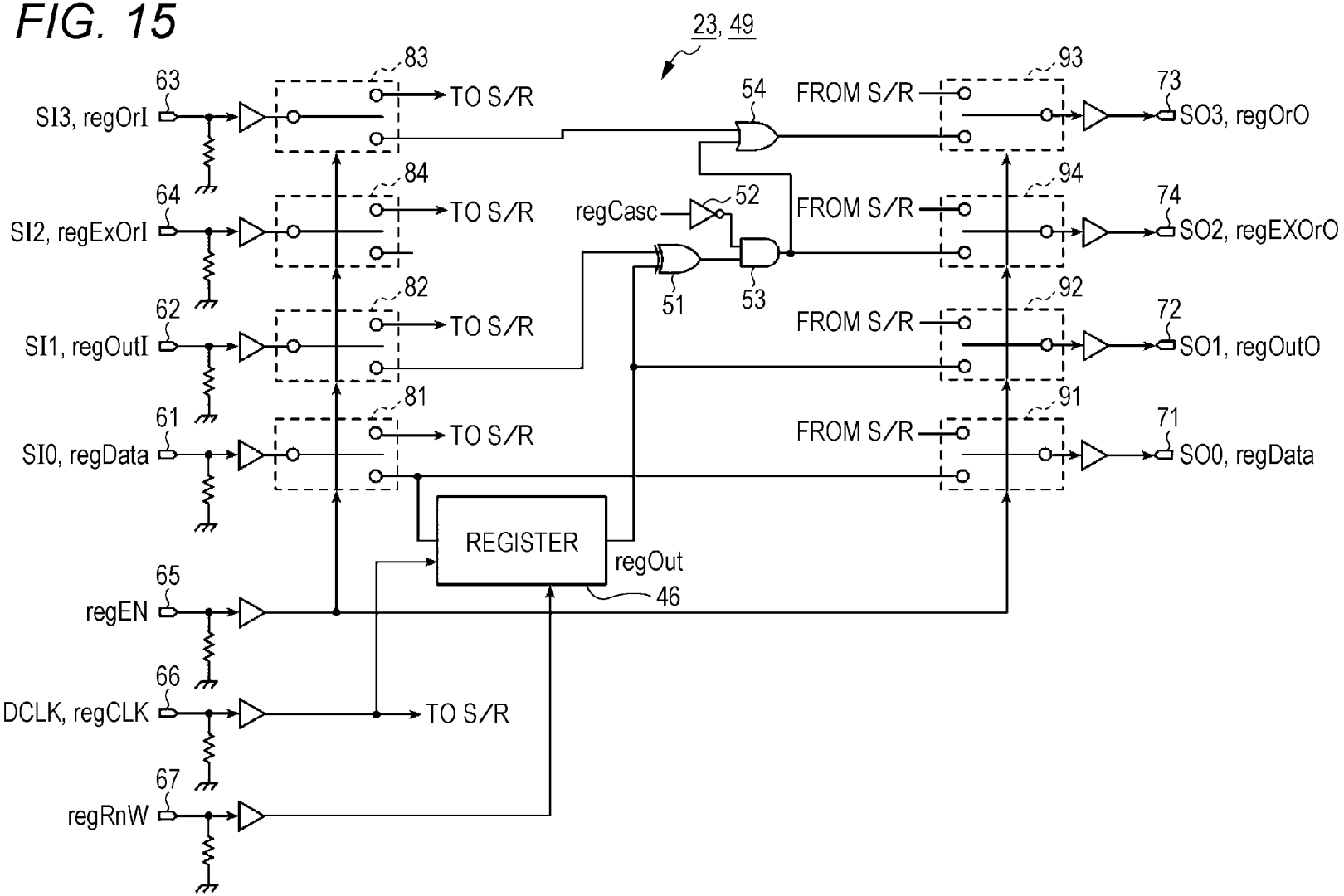
FIG. 15 is a view illustrating an input/output unit of a driving circuit according to a modified example 1.

FIG. 15 is a view illustrating the input/output unit 49 of one of the driving circuits 23 according to a modified example 1. Discussed chiefly herein is a difference between the configurations in FIG. 9 and in FIG. 15.

Each of the driving circuits 23 includes the four input units 61, 62, 63, and 64, and the four output units 71, 72, 73, and 74. The connection destinations of the input units 61, 62, and 63 and the output units 71, 72, and 73 are similar to the corresponding destinations in the foregoing embodiment. Each of the input unit 64 and the output unit 74 added in this example is connected with the shift register 41 when the enable signal regEN is negated. The output unit 74 is connected with the output of the AND circuit 53 when the enable signal regEN is asserted. The output unit 74 is electrically connected with the input unit 64 of the subsequent driving circuit 23.

According to this modified example 1, bit values SI0 to SI3 each containing 4-bit pixel data are input to the input units 61, 62, 63, and 64, while bit values SO0 to SO3 each containing 4-bit pixel data are output from the output units 71, 72, 73, and 74, at the time of transfer of pixel data.

On the other hand, in reading driving waveform pattern data from the register 46, the output unit 74 outputs an output result of the AND circuit 53 (exclusive OR output regExOrO). Accordingly, whether or not the reading data regOutI read from the preceding driving circuit 23 and input to the current driving circuit is different from the reading data regOutO of the current driving circuit 23 is detectable based on detection of output signals from the output units 74 of the second stage driving circuit 232Y and the third stage driving circuit 233Y. More specifically, when the reading data regOutI input to the driving circuit 23 and the reading data regOutO read from the driving circuit 23 are different, the exclusive OR output regExOrO as an output signal from the output unit 74 at the timing of the corresponding bit becomes "H".

According to the configuration of this modified example 1, the bit number of pixel data to be transferred may be 3 bit or smaller. In this case, only the necessary number of the input units and output units in correspondence with the bit number are used instead of the use of the four input units 61, 62, 63, and 64, and the four output units 71, 72, 73, and 74. According to the configuration of this modified example 1, the use of the input unit 64 and the output unit 74 may be prohibited in reading driving waveform pattern data from the register 46. The number of the input units and output units in this modified example 1 is not limited to four, but may be set to a larger number in the two numbers necessary for transfer of pixel data, and for the reading sequence.

According to the configuration of this modified example 1, therefore, it is detectable whether or not the reading data regOutI from the register 46 of the preceding driving circuit 23 is different from the reading data regOutO from the register 46 of the current driving circuit 23 based on detection of the exclusive OR output regExOrO from the output unit 74. According to the foregoing embodiment, it is detectable whether or not the reading data regOutO from the register 46 of at least one of the driving circuits 23 is different from the other data based on detection of the accumulated comparison data regOrO output from the output unit 73 of the driving circuit 23 at the final stage. According to this modified example 1, however, it is recognizable which of the driving circuits 23 includes the register 46 outputting the reading data regOutO different from the reading data regOutO of the preceding stage.

Modified Example 2

Figure 16:
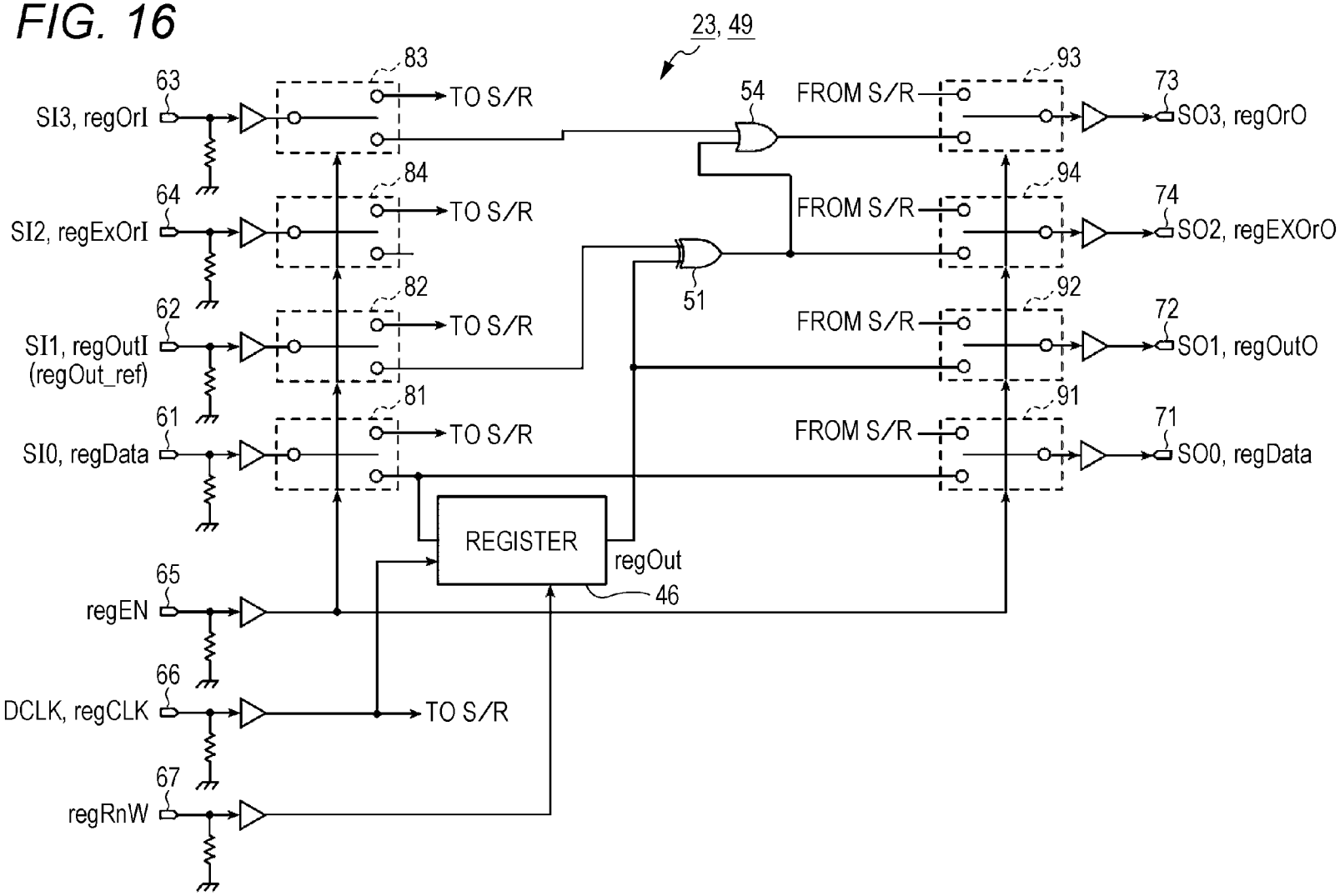
FIG. 16 is a view illustrating an input/output unit of a driving circuit according to a modified example 2.
Figure 17:
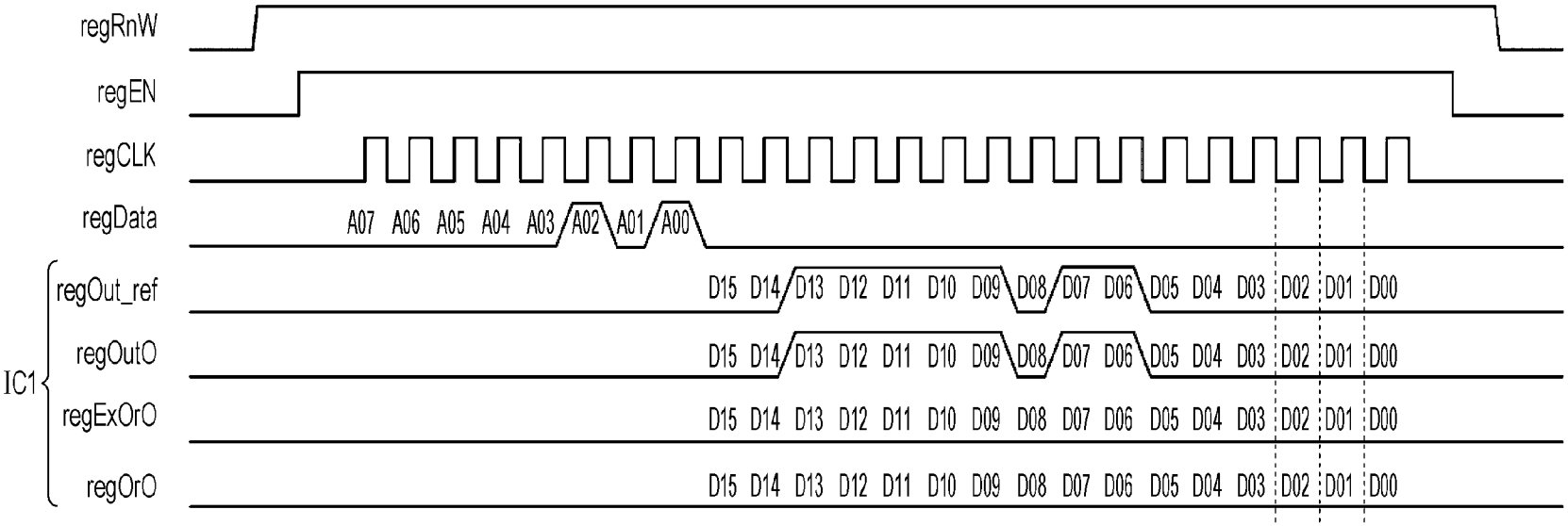
FIG. 17 is a timing chart showing an example of a reading sequence according to the modified example 2.

FIG. 16 is a view illustrating the input/output unit 49 of one of the driving circuits 23 according to a modified example 2. FIG. 17 is a timing chart showing an example of a reading sequence according to this modified example. Discussed chiefly herein is a difference between the configuration in FIG. 16 and the configuration of the modified example 1 shown in FIG. 15.

According to the driving circuit 23 illustrated in FIG. 16, the inverting circuit 52 and the AND circuit 53 are not equipped, and the output of the exclusive OR circuit 51 is directly connected with the input of the OR circuit 54 and the switch 94. Accordingly, the setting signal regCasc is not input to the driving circuit 23. According to the modified example 2, the exclusive OR circuit 51 corresponds to the comparison unit.

In this configuration, reference data regOut_ref shown in FIG. 17 is input to the input unit 63 of the first stage driving circuit 231Y in the reading sequence from the register 46. The reference data regOut_ref in this context is correct driving waveform pattern data input at the timing corresponding to the reading data regOutO from the register 46. The reference data regOut_ref is a mode of a predetermined reference data signal input to the exclusive OR circuit 51 (first stage comparison unit (first comparison unit)) corresponding to the comparison unit of the first stage driving circuit 231Y. According to this configuration, the exclusive OR circuit 51 of the first stage driving circuit 231Y compares the reading data regOutO from the register 46 and the reference data regOut_ref as the correct driving waveform pattern data, and outputs a comparison result. Accordingly, the exclusive OR circuit 51 outputs "L" when the reading data regOutO agrees with the reference data regOut_ref, without the necessity of the inverting circuit 52 and the AND circuit 53, and inputting the setting signal regCasc to the inverting circuit 52 as required in the configuration including in FIG. 9 associated with the foregoing embodiment and FIG. 15 associated with the modified example 1. In addition, according to the configurations illustrated in FIGS. 9 and 15, the AND circuit 53 always outputs "L" regardless of the value of the reading data regOutO. In this case, the error reading data regOutO of the first stage driving circuit 231Y, for example, is not detected when the reading data of the second stage driving circuit 232Y to the fourth stage driving circuit 234Y contains the same error. According to this modified example 2, however, the output of the exclusive OR circuit 51 becomes "H" when the reading data regOutO is error data, i.e., the reading data regOutO is different from the reference data regOut_ref. In this case, the "H" signal is output to the output units 73 and 74. Accordingly, even when the same error is contained in the reading data of the first stage driving circuit 231Y to the fourth stage driving circuit 234Y, this error is detectable based on detection of the error contained in the reading data regOutO of the first stage driving circuit 231Y.

According to this modified example 2, therefore, the first stage comparison unit (first comparison unit) of the first stage driving circuit 231Y includes the exclusive OR circuit 51.

One of the inputs of the exclusive OR circuit 51 receives the reading data regOutO from the register 46, while the other input of the exclusive OR circuit 51 receives data corresponding to a part associated with the reading data regOutO from the register 46, as predetermined reference data in the settings of the correct driving waveform pattern. Then, the first stage comparison unit (first comparison unit) obtains the output from the exclusive OR circuit 51 as a comparison result. This comparison result is output from the output unit 73 corresponding to the first stage result output unit (first result output unit). The second stage driving circuit 232Y outputs the accumulated comparison data regOrO (accumulated comparison result) from the output unit 73 corresponding to the second stage accumulated comparison result output unit (second accumulated comparison result output unit), as accumulated data obtained by accumulating the comparison result input to the input unit 63 corresponding to the second stage result input unit (second result input unit), and the comparison result of the exclusive OR circuit 51 corresponding to the second stage comparison unit (second comparison unit). This configuration eliminates the necessity of equipment of the inverting circuit 52 and the AND circuit 53, and the necessity of input of the setting signal regCasc to the respective driving circuits 23, thereby simplifying the configuration of the driving circuits 23. Moreover, the exclusive OR circuit 51 compares the reading data regOutO and the correct reference data regOut_ref, wherefore an error contained in the reading data regOutO is detectable at the first stage driving circuit 231Y. Furthermore, the second stage driving circuit 232Y accumulates and outputs the result of comparison between the reading data regOutO and the correct reference data regOut_ref at the first stage driving circuit 231, and the comparison result of the second stage driving circuit 232Y. Accordingly, error data written in the register 46 of the first stage driving circuit 231Y or the second stage driving circuit 232Y is easily recognizable based on detection of a signal output from the output unit 73 of the second stage driving circuit 232Y.

The third stage driving circuit 233Y electrically connected with the second stage driving circuit 232Y includes the input unit 63 to which the accumulated comparison data regOrO output from the output unit 73 of the second stage driving circuit 232Y is input, and the output unit 73 corresponding to the third stage accumulated comparison result output unit (third accumulated comparison result output unit) which accumulates the comparison result output from the exclusive OR circuit 51 as the third stage comparison unit (third comparison unit) and the accumulated comparison data regOrI input from the input unit 63, and outputs the accumulated result as the accumulated comparison data regOrO (accumulated comparison result). According to this configuration, error data written to the register 46 of any one of the first stage driving circuit 231Y, the second stage driving circuit 232Y, and the third stage driving circuit 233Y is easily recognizable based on detection of a signal output from the output unit 73 of the third stage driving circuit 233Y.

Instead of the foregoing configuration, the reading data regOut from the register 46 of the first stage driving circuit 231Y may be input to both the inputs of the exclusive OR circuit 51 of the first stage driving circuit 231Y. More specifically, in the configuration illustrated in FIG. 16, the output from the register 46 is input to one of the inputs of the exclusive OR circuit 51, and simultaneously to the other input of the exclusive OR circuit 51 via the input unit 62. According to this configuration, "L" is always output in a similar manner from the exclusive OR circuit 51 without equipment of the inverting circuit 52 and the AND circuit 53 as required in the configurations illustrated in FIGS. 9 and 15.

According to the modified example 2, such a configuration is adoptable which does not output the reading data from the register 46 of the first stage driving circuit 231Y to the subsequent second stage driving circuit 232Y. In this case, the second stage driving circuit 232Y to the fourth stage driving circuit 234Y correspond to the first driving circuit, the second driving circuit, and the third driving circuit, respectively.

Modified Example 3

An inkjet recording apparatus 1 according to a modified example 3 is hereinafter described.

Discussed in the foregoing embodiment is an example which stores driving waveform pattern data as parameters (predetermined setting) stored in the registers 46. However, the embodiment is not limited to this example. The parameters may be arbitrary data used as reference data at the time of recording by the inkjet recording apparatus 1, such as setting values defining a pixel data transfer mode.

The pixel data transfer mode in this context defines a decoding method of pixel data as input data to the driving circuits 23. The pixel data transfer mode is selected from a first pixel data transfer mode for 4-bit (16-gradation) pixel data, a second pixel data transfer mode for 2-bit (4-gradation) pixel data, and a third pixel data transfer mode for 1-bit (2-gradation) pixel data, for example.

In the first pixel data transfer mode, data for each bit (4 bits) of pixel data is input to each of the four input units 61, 62, 63, and 64, and output to the subsequent driving circuit 23 from the output units 71, 72, 73, and 74, as illustrated in FIG. 15.

In the second pixel data transfer mode, data for each bit of pixel data (2 bits) to be supplied to the odd-number ink ejection mechanisms is input to each of the input units 61 and 62, and output from the output units 71 and 72 to the subsequent driving circuit 23. On the other hand, data for each bit of pixel data to be supplied to even-number ink ejection mechanisms is input to each of the input units 63 and 64, and output from the output units 73 and 74 to the subsequent driving circuit 23.

In the third pixel data transfer mode, 1-bit pixel data to be supplied to the first, fifth, ninth, and up to (4n−3) th ink ejection mechanisms is input and output through the input unit 61 and the output unit 71, 1-bit pixel data to be supplied to the second, sixth, tenth, and up to (4n−2)th ink ejection mechanisms is input and output through the input unit 62 and the output unit 72, 1-bit pixel data to be supplied to the third, seventh, eleventh, and up to (4n−1)th ink ejection mechanisms is input and output through the input unit 64 and the output unit 74, and 1-bit pixel data to be supplied to the fourth, eighth, twelfth, and up to (4n)th ink ejection mechanisms is input and output through the input unit 63 and the output unit 73.

In the second or third pixel data transfer mode, the four input units 61, 62, 63, and 64 and the output units 71, 72, 73, and 74 are used not only for single transfer of pixel data, but also for a plurality of purposes of pixel data transfer at certain clock timing. In this case, the number of pixel data to be transferred per unit time increases.

In selecting the pixel data transfer mode, a setting value indicating selection of any one of the first to third pixel data transfer modes is stored in the register 46 beforehand, and the CPU 11 refers to this setting value for selection of the mode. Writing and reading of the setting value for selecting the pixel data transfer mode to and from the register 46 may be conducted in a manner similar to the manner of writing and reading of driving waveform pattern data described in the foregoing embodiment.

When the setting value for selecting the pixel data transfer mode is stored in the register 46, it is preferable that operations for writing and reading of the setting value are conducted for each formation of an image by the inkjet recording apparatus 1. It is at least necessary to conduct writing and reading of this setting value before formation of an image when the image is to be formed in a pixel data transfer mode different from the current setting selected by the inkjet recording apparatus 1.

While the specific embodiment and modified examples of the present invention have been described and depicted, the present invention is not limited to the embodiment and modified examples described herein. The present invention may be practiced otherwise in various aspects.

For example, while the input units 61, 62, and 63, and the output units 71, 72, and 73 are used for both the purposes of the input and output of pixel data, and of writing and reading of driving waveform pattern data to and from the registers 46 according to the foregoing embodiment, different input units and output units may be equipped for each purpose.

According to the foregoing embodiment, an address is input to the input unit 61 of the first stage driving circuit 231Y at the head, and then sequentially supplied to the subsequent driving circuits via the output units 71 in reading driving waveform pattern data from the registers 46. However, the mode for address input is not limited to this example. For example, an address may be directly input to the respective driving circuits 23 in an alternative mode. Similarly, in writing driving waveform pattern data to the registers 46, an address and driving waveform pattern data may be directly input to the respective driving circuits 23 in an alternative mode.

According to the foregoing embodiment, data is read from the registers 46 in response to input of an address of reading target driving waveform pattern data to the registers 46. However, data may be read from the registers 46 in response to input of a command for reading desired data to the registers 46 in an alternative mode. For example, in case of no designation of an address, all data of the registers 46 may be read out.

According to the foregoing embodiment, driving waveform pattern data is compared for each bit to detect agreement between data in reading the driving waveform pattern data. However, the unit for comparison is not limited to a bit as in this example. Any type of units for comparison may be adopted within a range defined by setting information.

For example, a plurality of bits in driving waveform pattern data may be read and compared for each set of the plurality of bits, or may be compared after reading the entire driving waveform pattern data. In case of these configurations, a part of the driving circuits 23 illustrated in FIG. 9, FIG. 15, or FIG. 16 may be changed in an appropriate manner.

The inkjet head 20 discussed in the foregoing embodiment is the inkjet head 20 in the shear mode which deforms the partition walls 29 of the channels 28. However, the mode of the ink ejection mechanisms is not limited to this example. For example, the present invention is applicable to an inkjet head including an ink ejection mechanism (flexural mode) which utilizes thin film oscillations of an ink chamber upper wall produced by a piezoelectric element, or applicable to a thermal type inkjet head.

According to the foregoing embodiment, the 512 nozzles are contained in each of the nozzle arrays 22 of the inkjet heads 20. However, the number of the nozzles is not limited to this number, but may be increased or decrease as necessary. While each of the inkjet heads 20 contains the single nozzle array 22 in the foregoing embodiment, each of the inkjet heads 20 may contain 2, 3, or a larger number of nozzle arrays.

According to the foregoing embodiment, the driving circuits 23 each corresponding to 128 channels are cascade-connected with each other. However, the number of the corresponding channels of each of the driving circuits 23 is not limited to this number, but may be increased or decreased as necessary.

Other specific configurations and positions described in the foregoing embodiment, such as the bit number of pixel data, the number of latch circuits, the shapes of driving voltage patterns, and the internal configuration of the respective driving circuits 23, may be changed in an appropriate manner without departing the scope of the present invention.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An inkjet head comprising a plurality of driving circuits, and ejecting ink in accordance with driving operation of the plurality of driving circuits based on a predetermined setting, wherein the plurality of driving circuits include a first driving circuit, and a second driving circuit electrically connected with the output of the first driving circuit, the first driving circuit includes a first storage unit that stores the predetermined setting, and a first setting output unit that reads at least a part of the predetermined setting and outputs the read part as reading data, and the second driving circuit includes a second storage unit that stores the predetermined setting, a second setting input unit to which output of the first setting output unit is input, a second comparison unit that compares reading data input from the second setting input unit, and data included in the predetermined setting stored in the second storage unit and corresponding to a part associated with the reading data, and a second result output unit that outputs a comparison result of the second comparison unit.

2. The inkjet head according to claim 1, wherein the plurality of driving circuits include a third driving circuit electrically connected with the output of the second driving circuit, the second driving circuit includes a second setting output unit that outputs, as reading data, at least a part of the predetermined setting stored in the second storage unit, and the third driving circuit includes a third storage unit that stores the predetermined setting, a third setting input unit to which output of the second setting output unit is input, a third result input unit to which a comparison result output from the second result output unit is input, a third comparison unit that compares reading data input from the third setting input unit, and data included in the predetermined setting stored in the third storage unit and corresponding to a part associated with the reading data, and a third accumulated comparison result output unit that outputs an accumulated comparison result obtained by accumulating a comparison result of the third comparison unit and a comparison result input from the third result input unit.

3. The inkjet head according to claim 2, wherein the first driving circuit includes a first setting information input unit to which setting information associated with the predetermined setting is input, and a first setting information output unit that outputs the setting information, the second driving circuit includes a second setting information input unit to which the setting information output from the first setting information output unit is input, and a second setting information output unit that outputs the setting information, the third driving circuit includes a third setting information input unit to which the setting information output from the second setting information output unit is input, and a range of reading data output from each of the first setting output unit and the second setting output unit, and a range of data included in the predetermined setting stored in the third storage unit, corresponding to a part associated with the reading data, and compared by the third comparison unit are defined based on the setting information.

4. The inkjet head according to claim 3, further comprising a reading/writing switch unit that allows switching between a writing mode for writing the predetermined setting to the first storage unit, the second storage unit, and the third storage unit, and a reading mode for outputting reading data from the first storage unit, the second storage unit, and the third storage unit, wherein the setting information contains the predetermined setting to be written in the writing mode.

5. The inkjet head according to claim 4, further comprising an input switch unit that switches output of input data input to the first setting information input unit, between output of the input data to the first storage unit, the second storage unit, and the third storage unit as the setting information associated with output of the predetermined setting writing or reading data, and output of the input data to a predetermined storage unit as input data for defining driving operation associated with an amount of the ink ejection.

6. The inkjet head according to claim 2, wherein the second comparison unit and the third comparison unit compare data for comparison by a predetermined unit of data.

7. The inkjet head according to claim 6, wherein the third accumulated comparison result output unit accumulates and outputs comparison results each containing different contents of the data compared by the predetermined unit of data.

8. The inkjet head according to claim 6, wherein the predetermined unit of data is one bit, the second comparison unit includes an exclusive OR circuit to which reading data input from the second setting input unit, and data included in the predetermined setting stored in the second storage unit and corresponding to a part associated with the reading data are input, and the third comparison unit includes an exclusive OR circuit to which reading data input from the third setting input unit, and data included in the predetermined setting stored in the third storage unit and corresponding to a part associated with the reading data are input.

9. The inkjet head according to claim 1, wherein the first driving circuit includes a first setting information input unit to which setting information associated with the predetermined setting is input, and a first setting information output unit that outputs the setting information, the second driving circuit includes a second setting information input unit to which the setting information output from the first setting information output unit is input, and a range of reading data output from the first setting output unit, and a range of data included in the predetermined setting stored in the second storage unit, corresponding to a part associated with the reading data, and compared by the second comparison unit are defined based on the setting information.

10. The inkjet head according to claim 9, further comprising a reading/writing switch unit that allows switching between a writing mode for writing the predetermined setting to the first storage unit and the second storage unit, and a reading mode for outputting reading data from the first storage unit and the second storage unit, wherein the setting information contains the predetermined setting to be written in the writing mode.

11. The inkjet head according to claim 10, further comprising an input switch unit that switches output of input data input to the first setting information input unit, between output of the input data to the first storage unit and the second storage unit as the setting information associated with output of the predetermined setting writing or reading data, and output of the input data to a predetermined storage unit as input data for defining driving operation associated with an amount of the ink ejection.

12. The inkjet head according to claim 1, wherein the second comparison unit compares data for comparison by a predetermined unit of data.

13. The inkjet head according to claim 12, wherein the predetermined unit of data is one bit.

14. The inkjet head according to claim 13, wherein the second comparison unit includes an exclusive OR circuit to which reading data input from the second setting input unit, and data included in the predetermined setting stored in the second storage unit and corresponding to apart associated with the reading data are input.

15. The inkjet head according to claim 1, wherein the predetermined setting is driving waveform pattern data that defines driving operation associated with the amount of ink ejection.

16. An inkjet recording apparatus comprising the inkjet head according to claim 1.

17. An inkjet head comprising a plurality of driving circuits, and ejecting ink in accordance with driving operation of the plurality of driving circuits based on a predetermined setting, wherein the plurality of driving circuits include a first driving circuit, and a second driving circuit electrically connected with the output of the first driving circuit, the first driving circuit includes a first storage unit that stores the predetermined setting, a first setting output unit that reads at least a part of the predetermined setting and outputs the read part as reading data, a first comparison unit that compares at least the part of the predetermined setting stored in the first storage unit and predetermined reference data, and a first result output unit that outputs a comparison result of the first comparison unit, and the second driving circuit includes a second storage unit that stores the predetermined setting, a second setting input unit to which output of the first setting output unit is input, a second comparison unit that compares reading data input from the second setting input unit, and data included in the predetermined setting stored in the second storage unit and corresponding to a part associated with the reading data, a second result input unit to which output from the first result output unit is input, and a second accumulated comparison result output unit that outputs an accumulated comparison result obtained by accumulating a comparison result of the second comparison unit and input from the second result input unit.

18. The inkjet head according to claim 17, wherein the plurality of driving circuits include a third driving circuit electrically connected with the output of the second driving circuit, the second driving circuit includes a second setting output unit that outputs, as reading data, at least a part of the predetermined setting stored in the second storage unit, and the third driving circuit includes a third storage unit that stores the predetermined setting, a third setting input unit to which output of the second setting output unit is input, a third accumulated comparison result input unit to which an accumulated comparison result output from the second accumulated comparison result output unit is input, a third comparison unit that compares reading data input from the third setting input unit, and data included in the predetermined setting stored in the third storage unit and corresponding to a part associated with the reading data, and a third accumulated comparison result output unit that outputs an accumulated comparison result obtained by accumulating a comparison result of the third comparison unit and an accumulated comparison result input from the third accumulated comparison result input unit.

19. The inkjet head according to claim 17, wherein the second comparison unit compares the data for comparison by a predetermined unit of data, and the second accumulated comparison result output unit accumulates and outputs comparison results each containing different contents of the data compared by the predetermined unit of data.

20. The inkjet head according to claim 17, wherein the first comparison unit includes an exclusive OR circuit to which the predetermined reference data, and the reading data from the first storage unit are input, and an AND circuit that has inputs one of which receives output from the exclusive OR circuit, a signal that defines output from the AND circuit as false is input to the other input of the AND circuit, and the first comparison unit obtains output from the AND circuit as a comparison result.

21. The inkjet head according to claim 17, wherein the first comparison unit includes an exclusive OR circuit that has inputs one of which receives the reading data from the first storage unit, and data included in the correct predetermined setting and corresponding to a part associated with the reading data from the first storage unit is input to the other input of the exclusive OR circuit as the predetermined reference data, and the first comparison unit obtains output from the exclusive OR circuit as a comparison result.

22. The inkjet head according to claim 17, wherein the first driving circuit includes a first setting information input unit to which setting information associated with the predetermined setting is input, and a first setting information output unit that outputs the setting information, the second driving circuit includes a second setting information input unit to which the setting information output from the first setting information output unit is input, and a range of reading data output from the first setting output unit, and a range of data included in the predetermined setting stored in the second storage unit, corresponding to a part associated with the reading data, and compared by the second comparison unit are defined based on the setting information.

23. The inkjet head according to claim 17, wherein the second comparison unit compares data for comparison by a predetermined unit of data.

24. The inkjet head according to claim 17, wherein the predetermined setting is driving waveform pattern data that defines driving operation associated with the amount of ink ejection.

25. An inkjet recording apparatus comprising the inkjet head according to claim 17.

* * * * *